US007381518B2

(12) United States Patent
Kawauchi

(10) Patent No.: US 7,381,518 B2
(45) Date of Patent: Jun. 3, 2008

(54) INFRARED-SENSITIVE PLANOGRAPHIC PRINTING PLATE PRECURSOR

(75) Inventor: Ikuo Kawauchi, Shizuoka-ken (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 11/503,993

(22) Filed: Aug. 15, 2006

(65) Prior Publication Data

US 2007/0048661 A1 Mar. 1, 2007

(30) Foreign Application Priority Data

Aug. 31, 2005 (JP) ..... 2005-252425

(51) Int. Cl.

| | |
|---|---|
| ***G03C 1/76*** | (2006.01) |
| ***G03C 1/725*** | (2006.01) |
| ***G03C 1/73*** | (2006.01) |
| ***G03C 1/735*** | (2006.01) |

(52) U.S. Cl. ..... 430/270.1; 430/281.1

(58) Field of Classification Search ..... 430/270.1, 430/281.1

See application file for complete search history.

(56) References Cited

U.S. PATENT DOCUMENTS

2006/0216638 A1* 9/2006 Watanabe ..... 430/270.1

FOREIGN PATENT DOCUMENTS

| | | |
|---|---|---|
| EP | 0 528 395 A1 | 2/1993 |
| EP | 1 211 065 A2 | 6/2002 |
| EP | 1 239 328 A2 | 9/2002 |
| EP | 1 400 351 A2 | 3/2004 |
| JP | 2002-46363 A | 2/2002 |
| JP | 2002-254843 A | 9/2002 |
| JP | 2003-63162 A | 3/2003 |
| JP | 2005-62456 A | 3/2005 |

* cited by examiner

*Primary Examiner*—Geraldina Visconti
(74) *Attorney, Agent, or Firm*—Sughrue Mion, Pllc.

(57) ABSTRACT

An infrared-sensitive planographic printing plate precursor including: a support; a recording layer capable of forming an image through infrared irradiation provided on or above one surface of the support, the recording layer containing a resin, which is water-insoluble and alkali-soluble, and an infrared absorbent; and an organic polymer layer provided on or above the other surface of the support, wherein when the organic polymer layer is formed, a solvent is used, and the total amount of solvent remaining in the organic polymer layer is 10 mg per gram of the organic polymer or less is provided.

12 Claims, 1 Drawing Sheet

INFRARED-SENSITIVE PLANOGRAPHIC PRINTING PLATE PRECURSOR

CROSS-REFERENCE TO RELATED APPLICATION

This application claims priority under 35 USC 119 from Japanese Patent Application No. 2005-252425, the disclosure of which is incorporated by reference herein.

BACKGROUND OF THE INVENTION

1. Field of the Invention

The present invention relates to an infrared-sensitive planographic printing plate precursor. More particularly, the present invention relates to an infrared-sensitive planographic printing plate precursor with improved prevention of damage to the photosensitive layer when the infrared-sensitive planographic printing plate precursors are stacked.

2. Description of the Related Art

Laser technology has made remarkable progress in recent years. In particular, high-power and compact solid lasers, semiconductor lasers and the like, having an emission wavelength within the near infrared and infrared regions are now readily available. In a planographic printing field, such lasers are advantageously used as light sources for exposing planographic printing precursors so as to produce printing plates directly according to digital data from a computer or the like.

A recording layer of such a positive planographic printing plate precursor for direct plate-making using infrared laser includes as essential components an alkali-soluble resin and an infrared absorbent which absorbs light and generates heat. In unexposed portions (i.e., an image area), the infrared absorbent acts as a dissolution inhibitor, which interacts with the alkali-soluble resin to substantially lower the solubility of the alkali-soluble resin. On the other hand, in exposed portions (i.e., a non-image area), the interaction of the infrared absorbent and the alkali-soluble resin becomes weak due to the heat generated, and the infrared absorbent dissolves in the alkaline developer to form an image. Such a positive planographic printing plate precursor, however, has problems in that the mechanical strength of the recording layer is insufficient. During manufacture, transportation and handling of the printing plate precursor, if the printing surface contacts other components heavily, defects in the printing surface can be generated, and missing portions can appear in the developed image area.

To reduce such problems, planographic printing plate precursors are usually packaged with interleaving sheets interposed between adjacent printing plate precursors. The interleaf sheets, however, have problems of cost and removal. Accordingly, "interleaf sheet-less" is desirable. Recently, as Computer-to-plate (CTP) systems become common, more and more exposure devices are provided with printing plate autoloaders. Such autoloaders, however, have the problem that the interleaf sheets need to be removed in advance from the stack through a bothersome manual operation, and that, even in an autoloader equipped with a device for automatically removing interleaf sheets, the printing plate precursors sometimes become scratched when removing the interleaf sheets. To avoid these problems, demand for planographic printing plate precursors stacked without interleaf sheets is increasing.

A known technique towards packaging without interleaf sheets is to provide supports with a back surface designed to reduce mechanical damage to photosensitive layers caused by contact between the photosensitive layers and the back surface of the supports.

For example, a recording material for offset printing which includes a radiation-sensitive layer and an organic polymer-containing backcoat layer is known. The recording material is provided with a backcoat consisting of an organic polymer having a glass transition temperature of not lower than 35° C., with a pigment such as silica gel contained therein (see Japanese Patent Application Laid-Open (JP-A) No. 2002-46363). The patent document describes that, with this configuration, planographic printing plate precursors can be stacked with no interleaf sheets interposed. However, inorganic pigments such as silica gel are very hard and if contained in the backcoat layer, the pigments can easily cause scratching of photosensitive layers during transportation of the printing plate precursors in a stacked state without interleaf sheets.

Another proposed technique is to provide a matte surface by electrostatic spraying onto a surface on the opposite side to that of a photosensitive layer on a support (see JP-A No. 2003-63162). The patent document describes that, with this configuration, planographic printing plate precursors can be stacked with no interleaf sheets interposed. However, if the printing plate precursors are stacked without interleaf sheets and stored, the adhesion of adjacent printing plate precursors can occur, especially under conditions of high-humidity such as in the summer.

Further, a photosensitive planographic printing plate precursor with a coating layer provided at a surface on the opposite side to that of a photosensitive layer on a support is proposed. The coating layer has a glass transition temperature of 60° C. or above and is formed by at least one resin selected from a group consisting of saturated copolyester resin, phenoxy resin, polyvinylacetal resin and vinylidene chloride copolymer resin (see JP-A No. 2005-62456).

Also, a photosensitive planographic printing plate precursor with a rough-surfaced organic polymer layer provided at a surface on the opposite side to that of a photosensitive layer on a support is also proposed (see, for example, JP-A No. 2002-254843).

These backcoat layers of organic polymer, however, can easily cause scratching of a photosensitive layer if no interleaf sheets are used and the photosensitive layer and the back surface are pressed against each other in an autoloader for automatically feeding printing plate precursors for laser exposure. Further, as mentioned above, a planographic printing plate precursor which has a recording layer including an alkali-soluble resin and an infrared absorbent and a backcoat layer of organic polymer has the following problems. That is, during manufacture after coating and drying printing plate precursors are cut and stacked and when the stacked printing plate precursors get load applied when on an autoloader, the relatively low strength surfaces of recording layers can adhere to the surfaces of backcoat layers due to solvent contained in the backcoat layer, and the recording layers sometimes peel off as a result of this adhesion.

SUMMARY OF THE INVENTION

In view of the aforementioned, the present invention provides an infrared-sensitive positive planographic printing plate precursor with effective suppression of the occurrence of scratching during transportation or adhesion defects to recording layers due to stress acting thereon during storage, even when stacked with no interleaf sheets. The planographic printing plate precursor can be advantageously used in an exposure device equipped with an autoloader.

A first aspect of the present invention is an infrared-sensitive planographic printing plate precursor comprising: a support; a recording layer capable of forming an image through infrared irradiation provided on or above one surface of the support, the recording layer comprising a resin, which is water-insoluble and alkali-soluble, and an infrared absorbent; and an organic polymer layer provided on or above the other surface of the support, wherein when the organic polymer layer is formed, at least one solvent is used, and the total amount of the solvent remaining in the organic polymer layer is 10 mg per gram of the organic polymer or less.

A second aspect of the present invention is the infrared-sensitive planographic printing plate precursor according to the first aspect, wherein the solvent(s) for the organic polymer layer is/are selected from low boiling point solvents used alone or in combination with other solvent(s).

A third aspect of the present invention is the infrared-sensitive planographic printing plate precursor according to the second aspect, wherein the solvent or a part of a mixture of solvents is a solvent having a boiling point lower than 150° C.

A forth aspect of the present invention is the infrared-sensitive planographic printing plate precursor according to the third aspect, wherein the solvent or a part of the mixture of solvents is a solvent having a boiling point lower than 100° C.

A fifth aspect of the present invention is the infrared-sensitive planographic printing plate precursor according to any one of the first to forth aspects, wherein the total amount of the solvent(s) remaining in the organic polymer layer is adjusted by controlling the drying conditions.

A sixth aspect of the present invention is the infrared-sensitive planographic printing plate precursor according to the fifth aspect, wherein the drying is performed while passing through a drying zone equipped with a non-contact heater.

A seventh aspect of the present invention is the infrared-sensitive planographic printing plate precursor according to the fifth aspect, wherein the drying is performed under strong drying conditions selected from high temperature drying, drying for an extended period, drying by application of a fast air-stream or other gas-stream, and combinations thereof.

An eighth aspect of the present invention is the infrared-sensitive planographic printing plate precursor according to the seventh aspect, wherein the drying is performed at a high temperature of 150° C. to 190° C.

A ninth aspect of the present invention is the infrared-sensitive planographic printing plate precursor according to the seventh aspect, wherein the drying is performed for a time of 30 seconds to 5 minutes.

A tenth aspect of the present invention is the infrared-sensitive planographic printing plate precursor according to the seventh aspect, wherein the drying is performed by a blowing with high pressure air or other gas.

An eleventh aspect of the present invention is the infrared-sensitive planographic printing plate precursor according to the seventh aspect, wherein the drying is performed by heating at a high temperature of 160° C. to 190° C. for 30 seconds to 2 minutes.

A twelfth aspect of the present invention is the infrared-sensitive planographic printing plate precursor according to the sixth aspect, wherein drying in the drying zone is selected from a group consisting of hot-air/hot-gas drying, high-pressure air /other gas drying, drying with a heat roller, and combinations thereof.

DETAILED DESCRIPTION OF THE INVENTION

Figure 1:
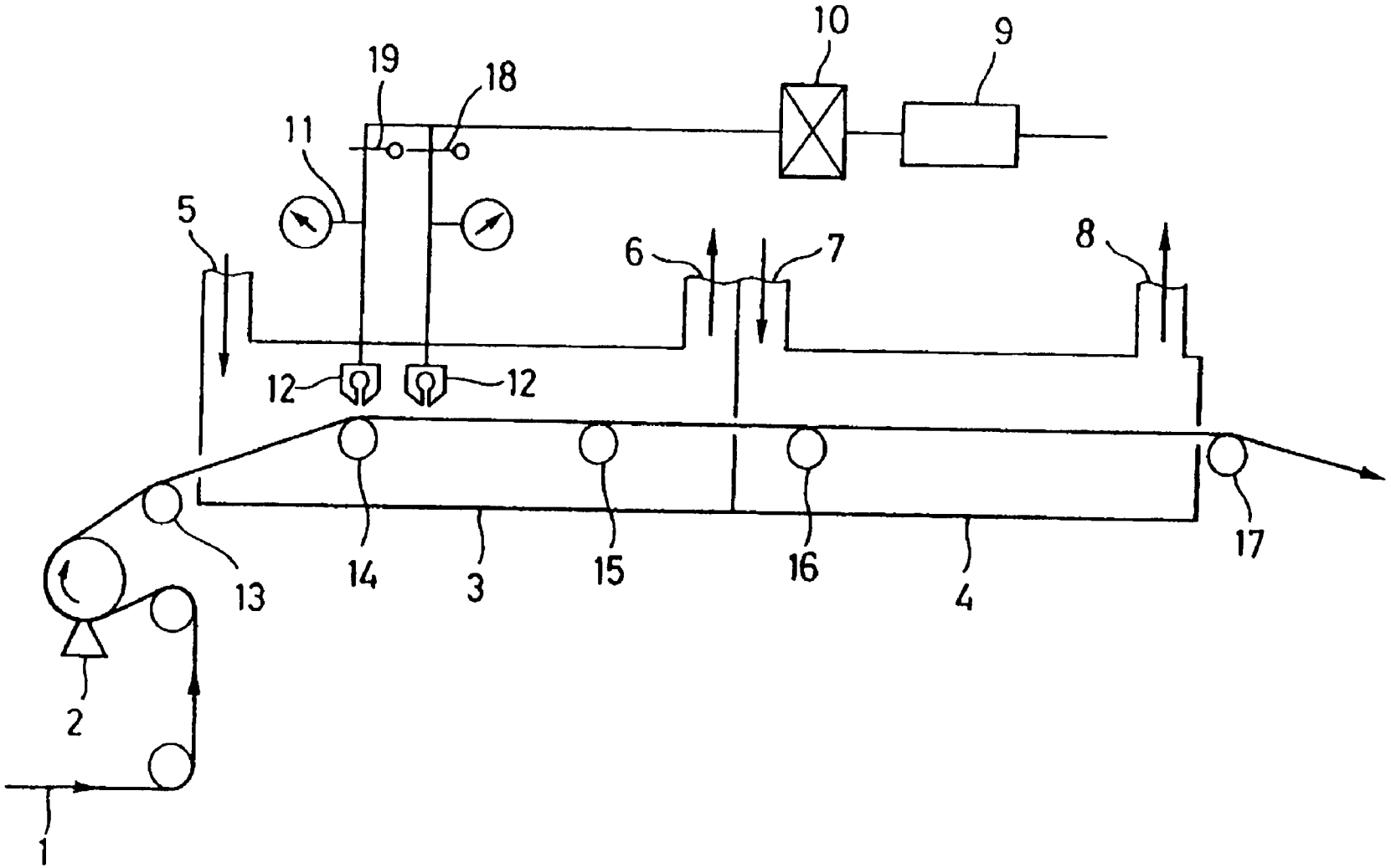
FIG. 1 is a schematic diagram of an embodiment of a continuous coating and drying apparatus used for forming an organic polymer layer in the present invention.

First, each element composing an infrared-sensitive planographic printing plate precursor according to the invention (hereinafter, called a planographic printing plate precursor) will be explained in detail.

[Organic Polymer Layer]

A planographic printing plate precursor according to the invention comprises a support, a recording layer provided on or above one surface of the support, and an organic polymer layer provided on or above the other surface of the support. In an embodiment of the present invention, when the organic polymer layer is formed, at least one solvent is used, and the total amount of solvent remaining in the organic polymer layer is 10 mg per gram of the organic polymer or less. The remaining amount of solvent is preferably 5 mg per gram of the organic polymer or less, and more preferably, 3 mg per gram of the organic polymer or less.

Hereinafter, components of the organic polymer layer will be explained in detail.

(Organic Polymer)

An organic polymer layer comprises an organic polymer as a base polymer for forming the layer. Examples of the organic polymer used as the base polymer include as follows, but the invention is not limited by these examples:

Novolac resin and pyrogallol acetone resin such as phenol formaldehyde resin, m-cresol formaldehyde resin, p-cresol formaldehyde resin, m-/p-mixed cresol formaldehyde resin, phenol/cresol (m-, p-, or mixed m-/p-) mixed formaldehyde resin, and the like.

At least one resin selected from a group consisting of saturated copolyester resin, phenoxy resin, polyvinylacetal resin and vinylidene chloride copolymer resin.

The saturated copolyester resin consists of a dicarboxylic acid unit and a diol unit. The specific examples of the dicarboxylic acid unit include aromatic dicarboxylic acids such as phthalic acids, terephthalic acids, isophthalic acids, tetrabromophthalic acids, tetrachlorophthalic acids, and the like; saturated aliphatic dicarboxylic acids such as adipic acids, azelaic acids, succinic acids, oxalic acids, suberic acids, sebacic acids, malonic acids, 1,4-cyclohexane dicarboxylic acids, and the like; and the like.

Examples of the diol unit include aliphatic diols such as ethylene glycol, diethylene glycol, triethylene glycol, polyethylene glycol, propylene glycol, dipropylene glycol, polypropylene glycol, 1,3-butylene glycol, 2,3-butylene glycol, 1,4-butylene glycol, neopentyl glycol, hexandiol, 2,2,4-trimethyl-1,3-pentane diol, and the like; cyclic diols such as 1,4-bis-beta-hydroxyethoxy cyclohexane, cyclohexane dimethanol, tricyclodecane dimethanol, bisphenol dioxyethyl ether, bisphenol dioxypropyl ether, and the like; and the like.

At least one of each of the dicarboxylic acid unit and the diol unit is used, and either the dicarboxylic acid unit or the diol unit is used as at least two of the copolymer units.

Properties of the copolymer depend on the composition, molecular weight and the like of the copolymer.

The organic polymer layer may be formed by heat compressing, melted laminating or the like of film, however, it is preferred to apply a coating solution of the organic polymer, from the viewpoint of forming efficiently thin film. Accordingly, when the copolyester resin is used as the organic polymer, it is preferably non crystalline and is easy to dissolve in organic solvents for industrial uses.

When the saturated copolyester resin is used as the organic polymer, molecular weight thereof is preferably 10,000 or more from the viewpoint of film strength of the organic polymer layer.

The phenoxy resin is prepared from a bisphenol A and an epichlorohydrin, as in the case of an epoxy resin. The phenoxy resin is advantageously used as a main component for the back coat which is excellent in the chemical resistance, adhesiveness, and the like, without assistance of a catalyst, a hardening agent, or the like compared to the epoxy resin.

The polyvinylacetal resin is a resin in which a polyvinyl alcohol is acetallized with an aldehyde such as butyl aldehyde or formaldehyde. Preferable examples of the polyvinylacetal resin include polyvinylbutyral resin, polyvinylformal resin, and the like. These polyvinylacetal resin has different physical properties or chemical properties depending on a degree of the acetalization, a compositon ratio of a hydroxy group and an acetyl group, or a degree of the polymerization. The organic polymer layer has preferably a glass transition temperature of 60° C. or above.

As the vinylidene chloride copolymer resin, copolymer resins of vinylidene chloride monomer and vinyl monomer such as vinyl chloride, vinyl acetate, ethylene, vinyl methyl ether, and the like, acrylic monomer such as (metha)acrylic ester, (metha)acrylonitrile, and the like. Among these, vinylidene chloride copolymer containing 20 mole % or less of acrylonitrile is preferred, from the viewpoint of having rich solubility for the general purpose organic solvent.

Content of the organic polymer contained in the organic polymer layer is preferably 99.99~70 mass % with respect to the total solid contents, and more preferably, 99.9~80 mass %, and still more preferably, 99.5~90 mass %.

The organic polymer layer may contain, in addition to the organic polymer described above, other hydrophobic polymers as needed. The specific examples of the hydrophobic polymer include polybutene, polybutadiene, polyamide, unsaturated copolyester resin, polyurethane, polyurea, polyimide, polysiloxane, polycarbonate, epoxy resin, chlolinated polyethylene, condensed resin of alkylphenol and aldehyde, polyvinyl chloride, polyvinylidene chloride, polystyrene, acrylic resin and copolymer resin of these compounds, hydroxy celluose, polyvinyl alcohol, cellulose acetate, carboxymethyl cellulose, and the like.

Further, examples of the hydrophobic polymers include copolymers having the following monomers (1 m)~(12 m) as a constituent unit, the copolymer having the molecular weight of 10,000~200,000.

(1m) Aromatic hydroxy group-containing acrylamides, methacrylamides, acrylic esters, methacrylic esters or hydroxystyrenes such as N-(4-hydroxyphenyl)acrylamide or N-(4-hydroxyphenyl)methacrylamide, o-, m-, or p-hydroxystyrene, o-, m-, or p-hydroxyphenyl acrylate or methacrylate.

(2 m) Aliphatic hydroxy group-containing acrylic esters or methacrylic esters such as 2-hydroxyethyl acrylate or 2-hydroxyethyl methacrylate.

(3 m) Substituted acrylic esters such as methyl acrylate, ethyl acrylate, propyl acrylate, butyl acrylate, amyl acrylate, hexyl acrylate, cyclohexyl acrylate, octyl acrylate, phenyl acrylate, benzyl acrylate, 2-choloethyl acrylate, 4-hydroxybutyl acrylate, glycidyl acrylate, N-dimethylaminoethyl acrylate, and the like.

(4 m) (Substituted) methacrylic esters such as methyl methacrylate, ethyl methacrylate, propyl methacrylate, butyl methacrylate, amyl methacrylate, hexyl methacrylate, cyclohexyl methacrylate, octyl methacrylate, phenyl methacrylate, benzyl methacrylate, 2-chloroethyl methacrylate, 4-hydroxybutyl methacrylate, glycidyl methacrylate, N-dimethyl aminoethyl methacrylate, and the like.

(5 m) Acrylamides or methacrylamides such as acrylamide, methacrylamide, N-methylol acrylamide, N-methylol methacrylamide, N-ethyl acrylamide, N-ethyl methacrylamide, N-hexyl acrylamide, N-hexyl methacrylamide, N-cyclohexyl acrylamide, N-cyclohexyl methacrylamide, N-hydroxyethyl acrylamide, N-hydroxyethyl methacrylamide, N-phenyl acrylamide, N-phenyl methacrylamide, N-benzyl acrylamide, N-benzyl methacrylamide, N-nitrophenyl acrylamide, N-nitophenyl methacrylamide, N-ethyl-N-phenyl acrylamide, N-ethyl-N-phenyl methacrylamide, and the like.

(6 m) Vinyl ethers such as ethyl vinyl ether, 2-chloroethyl vinyl ether, hydroxyethyl vinyl ether, propyl vinyl ether, butyl vinyl ether, octyl vinyl ether, phenyl vinyl ether, and the like.

(7 m) Vinyl esters such as vinyl acetate, vinyl chloroacetate, vinyl butyrate, vinyl benzoate, and the like.

(8 m) Styrenes such as styrene, methyl styrene, chloromethyl styrene, and the like.

(9 m) Vinyl ketones such as methyl vinyl ketone, ethyl vinyl ketone, propyl vinyl ketone, phenyl vinyl ketone, and the like.

(10 m) Olefines such as ethylene, propylene, isobutylene, butadiene, isoprene, and the like.

(11 m) N-vinylpyrrolidone, N-vinylcarbazole, 4-vinylpyridine, acrylonitrile, methacrylonitrile, and the like.

(12 m) Unsaturated sulfonamides of acrylamides such as N-(o-aminosulfonylphenyl)acrylamide, N-(m-aminosulfonylphenyl)acrylamide, N-(p-aminosulfonylphenyl) acrylamide, N-[1-(3-aminosulfonyl)naphtyl]acrylamide, N-(2-aminosulfonylethyl)acrylamide, and the like; unsaturated sulfonamides of methacrylamides such as N-(o-aminosulfonylphenyl)methacrylamide, N-(m-aminosulfonylphenyl)methacrylamide, N-(p-aminosulfonylphenyl)methacrylamide, N-[1-(3-aminosulfonyl)naphtyl]methacrylamide, N-(2-aminosulfonylethyl)methacrylamide, and the like; unsaturated sulfonamides of acrylic esters such as o-aminosulfonylphenyl acrylate, m-aminosulfonylphenyl acrylate, p-aminosulfonylphenyl acrylate, 1-(3-aminosulfonylphenylnaphthyl)acrylate, and the like; or unsaturated sulfonamides of methacrylic esters such as o-aminosulfonylphenyl methacrylate, m-aminosulfonylphenyl methacrylate, p-aminosulfonylphenyl methacrylate, 1-(3-aminosulfonylphenylnaphthyl)methacrylate, and the like.

Further, it is possible to copolymerize monomers capable of copolymerizing with the monomers described above. Copolymers obtained by copolymerizing the monomers described above may be used. Examples of the copolymers include copolymer modified with glycidyl acrylate, glycidyl methacrylate, or the like, but the invention is not limited thereto.

These hydrophobic polymers can be added in an amount of 50 mass % or less relative to the total solid contents in the organic polymer layer, however, they are preferably added in an amount of 30 mass % or less for the purpose of utilizing the characteristics of saturated copolyester resin, phenoxy resin, polyvinylacetal resin, and vinylidene chloride copolymer resin which are used preferably as the organic polymer.

(Other Components)

The organic polymer layer may contain a plasticizer, a surfactant, or the other additives for the purposes of imparting flexibility, controlling slipping property, improving coating surface, and the like, if necessary, as long as the effect of the invention is not thereby impaired.

Examples of the plasticizer include phthalic esters such as dimethyl phthalate, diethyl phthalate, dibutyl phthalate, diisobutyl phthalate, dioctyl phthalate, octyl capryl phthalate, dicyclohexyl phthalate, ditridecyl phthalate, butyl benzyl phthalate, diisodecyl phthalate, diallyl phthalate, and the like, glycol esters such as dimethyl glycol phthalate, ethyl phthalyl ethyl glycolate, methyl phthalyl ethyl glycolate, butyl phthalyl butyl glycolate, triethylene glycol dicaprylic ester, and the like, phosphoric esters such as tricresyl phosphate, triphenyl phosphate, and the like, aliphatic dibasic acid esters such as diisobutyl adiphate, dioctyl adiphate, dimethyl sebacate, dibutyl sebacate, dioctyl azelate, dibutyl maleate, and the like, polyglycidyl methacrylate, triethyl citrate, glycerine triacetyl ester, butyl laurylate, and the like.

Amount of the plasticizer to be added depends on types of the organic polymer used in the organic polymer layer. Preferably, the plasticizer may be added in an amount that the glass transition temperature does not become 60° C. or below.

Examples of the surfactant include anionic, cationic, nonionic, and amphoteric surfactants, and the like. The specific examples of the surfactants include nonionic surfactants such as polyoxyethylene alkyl ethers, polyoxyethylene alkylphenyl ethers, polyoxyethylene polystyrylphenyl ethers, polyoxyethylene polyoxypropylene alkyl ethers, partial esters of glycerin with fatty acids, partial esters of sorbitan with fatty acids, partial esters of pentaerythritol with fatty acids, mono-fatty acid esters of propylene glycol, partial esters of cane sugar with fatty acids, partial esters of polyoxyethylene sorbitan with fatty acids, partial esters of polyoxyethylene sorbitol with fatty acids, esters of polyethylene glycol with fatty acid, partial esters of polyglycerin with fatty acids, polyoxyethylated castor oils, partial esters of polyoxyethylene glycerin with fatty acids, fatty acid diethanolamides, N,N-bis-2-hydroxyalkylamines, polyoxyethylenealkylamines, esters of triethanolamine with fatty acids and trialkylamine oxides, and the like; anionic surfactants such as fatty acid salts, abietic acid salts, hydroxyalkane sulfonates, alkane sulfonates, dialkyl sulfosuccinates, straight-chain alkylbenzene sulfonates, branched alkylbenzene sulfonates, alkylnaphthalene sulfonates, alkylphenoxy polyoxyethylenepropyl sulfonates, polyoxyethylene alkylsulfophenyl ether salts, sodium N-methyl-N-oleyltaurates, disodium N-alkylsulfosuccinic acid monoamides, petroleum oil sulfonates, sulfated beef tallow oil, sulfates of fatty acid alkyl ester, alkyl sulfates, polyoxyethylene alkyl ether sulfates, fatty acid monoglyceride sulfates, polyoxyethylene alkylphenyl ether sulfates, polyoxyethylene styrylphenyl ether sulfates, alkyl phosphates, polyoxyethylene alkyl ether phosphates, polyoxyethylene alkylphenyl ether phosphates, partially saponified styrene/maleic acid anhydride copolymers, partially saponified olefin/maleic acid anhydride copolymers and naphthalene sulfonate formalin condensates, and the like; cationic surfactants such as alkylamine salts, quaternary ammonium salts, polyoxyethylenealkylamine salts and polyethylenepolyamine derivatives, and the like; and amphoteric surfactants such as carboxybetaines, aminocarboxylic acids, sulfobetaines, aminosulfates and imidazolines, and the like. The term "polyoxyethylene" in the surfactants mentioned above may be replaced with polyoxyalkylenes such as "polyoxymethylene", "polyoxypropylene" or "polyoxybutylene". The resulting surfactants are also given as examples of the surfactant used in the invention.

Further, examples of the surfactant include fluorine based surfactants containing a perfluoroalkyl group in a molecule. Specific examples of the fluorine based surfactant include an anionic type such as perfluoroalkyl carboxylates, perfluoroalkyl sulfonates and perfluoroalkyl phosphates, amphoteric type such as perfluoroalkyl betaines, cationic type such as perfluoroalkyl trimethyl ammonium salts and nonionic type such as perfluoroalkylamine oxides, perfluoroalkylethylene oxide adducts, perfluoroalkyl group- and hydrophilic group-containing oligomers, perfluoroalkyl group-, hydrophilic group- and lipophilic group-containing oligomers and perfluoroalkyl group- and lipophilic group-containing urethanes.

The above surfactants may be used alone or in combinations of two or more thereof. The surfactant is added into the organic polymer layer in a range from 0.001 to 10 mass % and preferably 0.01 to 5 mass %.

To the organic polymer layer, dyes for coloring, silane coupling agents for improving the adherence with the aluminum support, diazo resins consisting of diazonum salt, organic phosphonic acids, organic phosphoric acids or cationic polymers, and wax, higher fatty acid, higher fatty acid amide, silicone compound consisting of demethylsiloxane, modified dimethylsiloxane, polyethylene powder, and the like, which are used as a lubricant, can be further added appropriately.

The thickness of the organic polymer layer may be preferred to have the thickness that is difficult to harm the recording layer with no interleaf sheets, and is preferably 0.05~50 μm, and more preferably, 0.5~25 μm, and still more preferably, 1.0~20 μm. If the thickness of the organic polymer layer is within the range described above, when the planographic printing plate precursor is handled in a stacked state without interleaf sheets, it is possible to avoid efficiently the occurrence of scratching on the recording layers.

(Formation of Organic Polymer Layer)

An organic polymer layer in the invention can be formed as follows:

Each of components composing the organic polymer layer is dissolved in a solvent to obtain a coating solution, and the coating solution is then applied onto a surface (back side) of a support, i.e., the opposite side to that of the recording layer formed on the support to form an organic polymer layer. At this time, the amount of the solvent remaining in the organic polymer layer may be controlled to 10 mg per gram of the organic polymer or less depending on the solvent used, drying conditions or the like.

Controlling the amount of the solvent remaining in the organic polymer layer includes specifically a method in which a solvent having a boiling point lower than 150° C. is used as the solvent for forming the organic polymer layer, a method in which drying is performed under strong drying selected from high temperature drying, drying for an extended period, drying by application of a fast air-stream or other gas-stream, and combinations thereof, after applying the coating solution for the organic polymer layer onto the support, and the like.

The amount of the solvent remaining in the organic polymer layer is preferably 5 mg per gram of the organic polymer or less, and more preferably, 3 mg per gram of the organic polymer or less.

(Measurement of Remaining Amount of Solvent)

The amount of the solvent remaining in the organic polymer layer can be easily measured by gas chromatography, or the like. In the measurement, an organic polymer layer formed on the opposite side of the recording layer on the support is peeled from a planographic printing plate precursor to be measured, and used as a material to be measured.

As the specific measuring method, a known method in which a photosensitive surface of a sample is scraped off, and then, amount of the solvent is measured by a gas chromatograph fitted with a pyrolysis apparatus, and thus, the measured value is quantified by comparing with the measured value for the solvent in the known amount.

(Solvent for Coating)

In the preparation of a coating solution for the organic polymer layer, at least one solvent may be used. As the solvent, it is preferred to use a solvent having lower boiling point, specifically boiling point lower than 150° C., and more preferably, a solvent having boiling point lower than 100° C., from the viewpoint of decreasing the remaining amount of the solvent. The lower limit of the boiling point is not particularly limited, the solvent used generally in the preparation of the coating solution may be used.

From the viewpoint above, examples of the solvent used in the invention include a solvent having a boiling point lower than 100° C. such as ethylene dichloride, methyl ethyl ketone, methanol, ethanol, propanol, dimethoxyethane, 1,1,1,3,3,3-hexafluoro-2-propanol, and the like.

Further, a solvent having a boiling point of 100° C.~150° C. may be used. When the solvent is used, it is preferred to control drying conditions so as to remove sufficiently the solvent used. Examples of the solvent having a boiling point of 100° C.~150° C. include ethyleneglycol monomethyl ether, 1-methoxy-2-propanol, methyl lactate, toluene, and the like, but the invention is not limited thereto.

The solvents mentioned above may be used alone or in combination thereof, or may be used as a mixture with other solvent (s).

(Drying Process)

When the solvent or part of a mixture of solvents is a solvent having a boiling point of 150° C. or above, drying is performed under strong drying conditions in order to decrease the amount of the solvent remaining in the organic polymer layer.

The strong drying method useful in decreasing of the remaining amount of the solvent includes high temperature drying, i.e., drying under a heating conditions of 150° C.~190° C., drying for an extended period, i.e., drying for 30 seconds~5 minutes, or drying by application of a fast air-stream or other gas-stream, or combinations thereof.

Among these, from the viewpoint of decreasing the adverse effect on the coated layer, it is preferred to perform the drying for a short time such as 30 seconds~2 minutes at a high temperature of 160° C.~190° C.

As a heating method, the known method may be optionally used. Specifically, drying is preformed while passing through a drying zone equipped with a non-contact heater, or the like, but the invention is not limited thereto.

Further, examples of drying and removing sufficiently the solvent include blowing with high-pressure air or other gas from a slit nozzle disposed substantially perpendicular to the running direction of the web, applying heat energy as a conductive heat by a roller (heat roller) to which a heating medium such as steam or the like is internally fed, and combinations thereof.

An apparatus illustrated in FIG. 1 comprises a coating head 2 for applying a coating solution for an organic polymer layer onto a support 1, a first drying zone 3 for performing drying with hot-air/hot-gas and fast drying by blowing with high-pressure air/other gas, and a second drying zone 4 for performing drying with hot-air/hot-gas. The first drying zone 3 comprises an opening 5 for supplying hot-air/hot-gas, a unit 9 generating high-pressure air/other gas for performing fast drying, a heat exchanger 10, a pressure gauge 11, a nozzle 12 for blowing high-pressure air/other gas, an air flow controlling dampers 18, 19, and an outlet 6 for exhausting hot-air/hot-gas outside. Further, the second drying zone 4 comprises an opening 7 for supplying hot-air/hot-gas and an outlet 8 for exhausting hot-air/hot-gas outside. In addition, guide rollers 13~17 for conveying an aluminum web as the support 1 are disposed at an appropriate position.

In the apparatus, while the support 1 is running continuously at a speed of 5~150 m/min, a coating solution for an organic polymer layer is applied onto the support 1 such that 5~40 ml/m$^2$ of the coating solution is coated onto the support 1 by using a coating head 2. Thereafter, the support coated with the coating solution is guided into the first drying zone 3 where drying is performed at a normal temperature of 50~150° C. As a result, the solvent gas evaporates, and the gas is exhausted with the hot-air/other gas through the outlet 6 outside. In the vicinity of the opening in the first drying zone 3, the coated organic polymer layer is ordinarily under drying at the stage of drying with hot-air/other gas.

The coated organic polymer layer under drying is very quickly dried by fast air stream or other gas stream blowing through a nozzle 12 disposed substantially perpendicular to the movement direction of the support 1 on the conveying movement.

High-pressure air/other gas generated by the unit 9 consisting of a compressor or a high pressure blower is heated to 50~120° C. by the heat exchanger 10, air flow thereof is controlled at a desired volume by the air flow controlling dampers 18, 19, and then, the high pressure air/other gas is supplied through the nozzle 12. It is possible to form an organic polymer layer (back coat layer) by impacting intensively the slit high pressure air/other gas at a desired temperature and velocity onto the coated organic polymer layer under drying for a very short time to evaporate rapidly the solvent. Generally, the pressure in the nozzle 12 is 300 mmAq ($H_2O$)~3 kg/cm$^2$, and prefrably 1000 mmAq~1 kg/cm$^2$. The velocity of the air flow blowing from the nozzle 12 is 20 m/s~300 m/s. The width between the slits on the nozzle 12 is 0.1 mm~5 mm, and preferably 0.3 mm~1 mm. The blowing angle of the high pressure air/other gas to the support 1 is 0°~90°, and preferably 10°~60°. Further, two nozzles are depicted in the figure for convenience, but the number of the nozzle may vary 1~8 depending on the drying load.

Then, the coated organic polymer layer which is fast dried at the first drying zone 3 is formed. Thereafter, the support coated with the organic polymer layer is guided into the second drying zone 4 and heated with hot-air/hot-gas having a temperature of 100° C.~150° C. from the opening 7. Accordingly, the amount of solvent remaining in a minute amount in the coated organic polymer layer is controlled in a range of 30~200 mg/m$^2$. Further, the dissolved solvent gas is exhausted outside together with the hot-air/hot-gas through the outlet 8. Then, it is possible to achieve the effective decreasing of the solvent amount remaining in the coated layer by the drying treatment.

Further, in forming a back coat layer in an embodiment of the invention, drying with a heat roller may be performed instead of drying by application of a fast air stream or other gas stream described above. In an apparatus used for drying with a heat roller, the guide roller 14 functions as the heat roller, and therefore, the high pressure air/gas generating unit 9, the heat exchanger 10, the pressure gauge 11, the nozzle 12 and air flow controlling dampers 18, 19 are not necessary. Such a case, it is possible to heat the roller surface to a temperature of 80° C.~200° C. by supplying internally a heating medium such as steam and the like into the roller. Accordingly, heat energy can be supplied between the heated surface of the roller and the aluminum web of the support 1 and thus, drying can be attained.

Further, as a method of removing quickly the solvent, drying by application of fast air stream or other gas stream may be combined with drying with a heat roller. An apparatus used therefor includes, for example, the guide roller 14 functioning as the heat roller in FIG. 1 as described above, and thus, it is possible to evaporate rapidly the solvent.

In addition, in an embodiment illustrated in FIG. 1, at the first drying zone 3, drying with hot-air/hot-gas is performed and then, a combination of drying with hot-air/hot-gas and drying with a high pressure air/other gas or drying with a heat roller is performed. However, the initial drying with hot-air/hot-gas is omitted, and drying with a high pressure air/other gas may be performed immediately after coating.

(Properties of Organic Polymer Layer)

The organic polymer layer has a property in that a dynamic friction coefficient on a surface of the organic polymer layer is in a range of 0.20~0.70 from the viewpoint in that the effect of the invention is exerted sufficiently.

The expression "dynamic friction coefficient" means a value measured by placing a surface of the organic polymer layer so as to contact with a surface of the recording layer that is opposite to the organic polymer layer according to the standard ASTM D1894, the disclosure of which is incorporated by reference herein.

The infrared-sensitive planographic printing plate precursor has an organic polymer layer described above, and therefore, it is possible to suppress the occurrence of scratching or adhesion defects to recording layers, such as adhesion to the organic polymer layer, and peeling off and damage to the recording layer caused by the adhesion during manufacture and plate-making, or during conveyance in packaging and transportation after product shipment, even when stacked with no interleaf sheets.

The recording layer of the planographic printing plate precursor used in the invention contains, as main components, an alkali soluble resin having an acid group and an infrared absorbent which functions as a dissolution inhibitor that imparts an alkaline resistance in a developer to the resin. The recording layer has a relatively small strength, and is apt to be affected to the humidity. However, by forming a back side (including an organic polymer layer) so that a surface of the recording layer may contact with the back side, there is not occurred the scratching defects to the recording layers due to vibration during transportation even when the planographic printing plate precursors containing the recording layer are stacked, packed and transported. Further, when the stacked precursor is stored for a long time under circumstances of high temperature and high humidity, or is stored under the stress acting thereon, there are not occurred adhesion defect between the recording layer and the organic polymer layer, or peeling off the recording layer due to the adhesion. In addition, when the precursors get load applied on an exposure device equipped with a autoloader, there is not occurred scratching defect to the recording layer during transportation, even when the stacked precursors are transported in a state that a surface of the recording layer and a part of the back side are pressed against each other. Hereinafter, the recording layer in the planographic printing plate precursor will be explained.

(Recording Layer)

In an embodiment of the planographic printing plate precursor, a recording layer is capable of forming an image through infrared irradiation. Such a recording layer may have a monolayer structure or a multilayer structure. When the recording layer has a monolayer structure, a water-insoluble and alkali-soluble resin and an infrared absorbent may be contained therein. Further, when the recording layer has a multilayer structure, a water-insoluble and alkali-soluble resin may be contained in any layer, and at least one of a layer closest to the support (hereinafter, called "lower layer") and a layer farthest from the support (hereinafter, called "outermost layer") contains an infrared absorbent.

(Water-Insoluble and Alkali-Soluble Resin)

The water-insoluble and alkali-soluble resin (hereinafter, called alkali-soluble resin) that may be used in the recording layer of the invention includes homopolymers containing an acidic group in a main chain and/or a side chain of the polymer, and a copolymer or a mixture of these homopolymers. Accordingly, the recording layer of the invention has characteristics as being soluble in an alkaline developer upon contact therewith. The alkali-soluble resin is not particularly limited, and any of the known resins may be used. As the alkali-soluble resin, polymers having, in a molecule, at least one acidic group selected from a group consisting of (1) a phenolic hydroxy group, (2) a sulfonamide group, (3) an active imide group, and (4) a carboxylic group are preferred. The specific examples of the alkali-soluble resin used in the invention include the following compounds, however, the invention is not limited thereto.

(1) Examples of the polymers having a phenolic hydroxy group may include novolak resin such as phenol formaldehyde resin, m-cresol formaldehyde resin, p-cresol formaldehyde resin, m-/p-mixed cresol formaldehyde resin, and phenol/cresol (m-, p-, or m-/p-mixture) mixed formaldehyde resin, and the like; pyrogallol acetone resin, and the like.

Further, as the alkali-soluble resin having a phenolic hydroxy group, resins produced by condensing a substituted phenol represented by the following formula (i) with an aldehyde are preferably used.

(i)

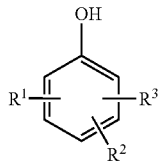

In the formula (i), $R^1$ and $R^2$, respectively, represent a hydrogen atom, an alkyl group, or a halogen atom. The alkyl group is preferably an alkyl group having 1~3 carbon atoms, and more preferably, an alkyl group having 1 or 2 carbon atoms. The halogen atom is preferably a fluorine atom, a chlorine atom, a bromine atom, or an iodine atom, and more preferably, a chlorine atom, or a bromine atom. $R^3$ represents an alkyl group having 3~6 carbon atoms or a cycloalkyl group.

The specific examples of the substituted phenols represented by the formula (i) include isopropyl phenol, t-butyl phenol, t-amyl phenol, hexyl phenol, cyclohexyl phenol, 3-methyl-4-chloro-6-t-butyl phenol, isopropyl cresol, t-butyl cresol, t-amyl cresol, and the like. Among these, t-butyl phenol or t-butyl cresol is preferred.

Examples of the aldehydes used in the condensation with the substituted phenols described above include aliphatic or aromatic aldehydes such as formaldehyde, acetoaldehyde, acrolein, crotonaldehyde and the like. Among these, formaldehyde or acetoaldehyde is preferred.

As the alkali-soluble resin having a phenolic hydroxy group, polymers having a phenolic hydroxy group at the side chain may be used. Examples of the polymers having a phenolic hydroxy group at its side chain include polymers obtained by homopolymerizing a polymerizable monomer comprising a low-molecular compound having one or more phenolic hydroxy groups and one or more unsaturated bonds polymerizable therewith or by copolymerizing this monomer with other polymerizable monomers.

Examples of the polymerizable monomer having a phenolic hydroxy group include acrylamides, methacrylamides, acrylates and methacrylates each having a phenolic hydroxy group, hydroxystyrenes, and the like. Specific examples of the polymerizable monomer which may be preferably used include N-(2-hydroxyphenyl)acrylamide, N-(3-hydroxyphenyl)acrylamide, N-(4-hydroxyphenyl)acrylamide, N-(2-hydroxyphenyl)methacrylamide, N-(3-hydroxyphenyl)methacrylamide, N-(4-hydroxyphenyl)methacrylamide, o-hydroxyphenylacrylate, m-hydroxyphenylacrylate, p-hydroxyphenylacrylate, o-hydroxyphenylmethacrylate, m-hydroxyphenylmethacrylate, p-hydroxyphenylmethacrylate, o-hydroxystyrene, m-hydroxystyrene, p-hydroxystyrene, 2-(2-hydroxyphenyl)ethyl acrylate, 2-(3-hydroxyphenyl) ethyl acrylate, 2-(4-hydroxyphenyl)ethyl acrylate, 2-(2-hydroxyphenyl)ethyl methacrylate, 2-(3-hydroxyphenyl)ethyl methacrylate and 2-(4-hydroxyphenyl)ethyl methacrylate. Two or more types of these resins having a phenolic hydroxy group may be used in combination.

Further, as the alkali-soluble resin having a phenolic hydroxy group used in the invention, the alkali-soluble resin of which the phenolic hydroxy groups have been at least partially esterified, as disclosed in JP-A No. 11-288089, may also be included.

(2) Examples of the alkali-soluble resin having a sulfonamide group include polymers obtained by homopolymerizing polymerizable monomers having a sulfonamide group or by copolymerizing the monomer with other polymerizable monomers. Examples of the polymerizable monomer having a sulfonamide group include polymerizable monomers comprising a low-molecular compound having, in one molecule thereof, one or more sulfonamide groups —NH—$SO_2$— in which at least one hydrogen atom is bonded to a nitrogen atom and one or more unsaturated bonds polymerizable therewith. Among these polymers, low-molecular compounds having an acryloyl group, allyl group or vinyloxy group and a substituted or monosubstituted aminosulfonyl group or substituted sulfonylimino group are preferable.

The specific examples of the alkali-soluble resin having a sulfonamide group include resins described in JP-A-7-69605.

(3) The alkali-soluble resin having an active imide group is preferably those having an active imide group (—CO—NH—$SO_2$—) in its molecule. Examples of the resin include polymers obtained by homopolymerizing a polymerizable monomer comprising a low-molecular compound having one or more active imide groups and one or more unsaturated bonds polymerizable therewith or by copolymerizing this monomer with other polymerizable monomers.

Specifically, as such a compound, N-(p-toluenesulfonyl) methacrylamide and N-(p-toluenesulfonyl)acrylamide, for example, may be suitably employed.

(4) Examples of the alkali-soluble resin having a carboxylic group may include polymers obtained by homopolymerizing a polymerizable monomer comprising a low-molecular compound having, in a molecule, one or more carboxylic groups and one or more unsaturated bonds polymerizable therewith or by copolymerizing this monomer with other polymerizable monomers. Examples of the polymerizable monomer having a carboxlic group include α, β-unsaturated carboxylic acids of acrylic acids, methacrylic acids, maleic acids, maleic anhydrides, itaconic acids and the like. Further, unsaturated carboxylic acids that are monoesters of a hydroxy group in acrylates or methacrylates having a hydroxy group at a side chain, for example, 2-hydroxyethyl acrylate or methacrylate, and a dibasic acid (for example, succinic acids, glutaric acids, phthalic acids, and the like) may be included.

Further, as the alkali-soluble resin in the invention, polymers obtained by polymerizing two or more of the polymerizable monomer having a phenolic hydroxy group, the polymerizable monomer having a sulfoneamide group, the polymerizable monomer having an active imide group and the polymerizable monomer having a carboxylic group, or by copolymerizing these two or more polymerizable monomers with the other polymerizable monomers may be used.

When the alkali-soluble resin is copolymers of the above monomer having an acidic group (phenolic hydroxy group, sulfonamide group, active amide group, carboxylic group) and the other polymerizable monomers, in terms of achieving superior developing properties, the monomer imparting alkaline solubility is preferably contained in an amount of 10 mol % or more, and more preferably 20 mol % or more.

Examples of the other monomers copolymerized with the monomer having an acidic group include the following compounds (m1) to (m11), but the invention is not limited thereto.

(m1) Acrylic acid esters and methacrylic acid esters having aliphatic hydroxy groups such as 2-hydroxyethyl acrylate, 2-hydroxyethyl methacrylate and the like.

(m2) Alkyl acrylates such as methyl acrylate, ethyl acrylate, propyl acrylate, butyl acrylate, amyl acrylate, hexyl acrylate, octyl acrylate, benzyl acrylate, 2-chloroethyl acrylate, glycidyl acrylate, and the like.

(m3) Alkyl methacrylates such as methyl methacrylate, ethyl methacrylate, propyl methacrylate, butyl methacrylate, amyl methacrylate, hexyl methacrylate, cyclohexyl methacrylate, benzyl methacrylate, 2-chloroethyl methacrylate, glycidyl methacrylate, and the like.

(m4) Acrylamides or methacrylamides such as acrylamide, methacrylamide, N-methylol acrylamide, N-ethylacrylamide, N-hexylmethacrylamide, N-cyclohexylacrylamide, N-hydroxyethylacrylamide, N-phenylacrylamide, N-nitrophenylacrylamide, N-ethyl-N-phenylacrylamide, and the like.

(m5) Vinyl ethers such as ethyl vinyl ether, 2-chloroethyl vinyl ether, hydroxyethyl vinyl ether, propyl vinyl ether, butyl vinyl ether, octyl vinyl ether, phenyl vinyl ether, and the like.

(m6) Vinyl esters such as vinyl acetate, vinyl chloroacetate, vinyl butyrate, vinyl benzoate, and the like.

(m7) Styrenes such as styrene, α-methylstyrene, methylstyrene, chloromethylstyrene, and the like.

(m8) Vinyl ketones such as methyl vinyl ketone, ethyl vinyl ketone, propyl vinyl ketone, phenyl vinyl ketone, and the like.

(m9) Olefines such as ethylene, propylene, isobutylene, butadiene, isoprene, and the like.

(m10) N-vinylpyrrolidone, acrylonitrile, methacrylonitrile, and the like.

(m11) Unsaturated imides such as maleimide, N-acryloylacrylamide,

N-acetylmethacrylamide, N-propionylmethacrylamide, N-(p-chlorobenzoyl)methacrylamide, and the like.

Methods of copolymerizing the alkali soluble resin include graft copolymerization, block copolymerization, random copolymerization, and the like, which are conventionally known.

When the alkali-soluble resin used in the invention is a homopolymer or a copolymer of a polymerizable monomer having an acidic group described above, it preferably has weight-average molecular weight of 2,000 or more and more preferably, weight-average molecular weight of 5,000 to 300,000. Further, when the alkali-soluble resin used in the invention is a resin such as phenol formaldehyde resin, cresol aldehyde resin, and the like, it preferably has weight-average molecular weight of 500 to 50,000, and more preferably, 700 to 20,000, and still more preferably, 1,000 to 10,000.

When the recording layer has a multilayer structure, as the alkali soluble resin used in the outermost layer of the recording layer is preferably a resin having a phenolic hydroxy group from the standpoint of being capable of forming strong hydrogen bonding in an unexposed area while readily releasing some of the hydrogen bonds in an exposed area. In particular, a novolak resin is preferred.

In the invention, two or more kinds of alkali-soluble resins of which dissolving rate in an aqueous alkaline solution is different each other may be used as a mixture, and, in such a case, the mixing ratio thereof may be freely determined. In the multilayer type recording layer, as an alkali-soluble resin that is preferably mixed with the resin having a phenolic hydroxy group, which is used preferably in the outermost layer, an acrylic resin is preferable since it has a low compatibility with the resin having a phenolic hydroxy group, and an acrylic resin having a sulfonamide group or a carboxylic group is more preferable.

When the recording layer has the multilayer structure, the alkali soluble resin is used in the lower layer of the recording layer. The lower layer itself needs to develop high alkaline solubility. Further, it is required for resistance to the various chemicals on printing and stable printability under the printing conditions. As a result, it is preferably to select a resin that the characteristics are not impaired. From this viewpoint, it is preferred to select a resin that is excellent in solubility in alkaline developer, resistance to the printing chemicals, mechanical strength, and the like. Further, as the alkali soluble resin used in the lower layer, it is preferred to use a resin having a low solubility to the solvent, which is not dissolved in the coating solution for the outermost layer that is applied on the lower layer. Accordingly, by selecting such resin, undesired compatibility at the boundary between two layers can be suppressed.

Examples of the alkali-soluble resin that is contained in the lower layer include, in addition to the resin described above, polyamide resins, epoxy resins, polyvinylacetal resins, styrene resins, urethane resins, and the like, which are water insoluble and alkali soluble, may be used.

The water insoluble and alkali soluble polyurethane resin (hereinafter, call "polyurethane resin") described above is not particularly limited as long as it is insoluble in water and soluble in aqueous alkaline solutions. Among these, it is preferably a resin having a carboxylic group in the main chain. Examples of the polyurethane resin include polyurethane resins having, in the basic skeleton, a reaction product of diisocynate compounds represented by the following formula (ii) and at least one of diol compounds having a carboxylic group represented by the following formulae (iii) or (iv), and the like.

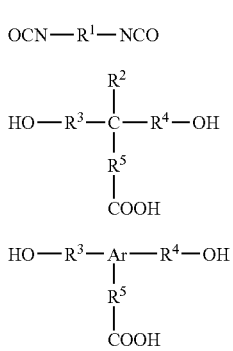

(ii)

(iii)

(iv)

In the formula (ii), $R^1$ represents a bivalent linking group. The bivalent linking group includes aliphatic hydrocarbons, alicyclic hydrocarbons, or aromatic hydrocarbons. Preferred examples of the bivalent linking group include alkylene groups having 2~10 carbon atoms, arylene groups having 6~30 carbon atoms, and the like. The arylene group may be groups in which two or more cyclic structures are bonded through a single bond or a bivalent organic linking group such as methylene group, or they form a condensed polycyclic structure. If necessary, $R^1$ may have the other functional groups that does not react with an isocyanate group, such as ester group, urethane group, amide group, ureido group, and the like.

In the formula (ii), $R^1$ may have a substituent. Examples of the substituent which may be introduced include a halogen atom such as —F, —Cl, —Br, —I and the like, an alkyl group, an alkoxy group, an alkyl ester group, a cyano group, and the like, which are substituents inactive to the isocyante group.

Further, examples of the diisocyanate compound include, besides the compounds represented by the formula (ii), high molecular weight diisocyanate compounds having an isocyanate group on both ends of polymers such as oligomer or polymer obtained from the diol compounds described below.

In the formula (iii), $R^2$ represents a hydrogen atom, an alkyl group, an aralkyl group, an aryl group, an alkoxy group, or an aryloxy group. The $R^2$ may have a substituent, and examples of the substituent include a cyano group, a nitro group, a halogen atom such as —F, —Cl, —Br, —I, and the like, —$CONH_2$, —$COOR_6$,—$OR^6$, —$NHCONHR^6$, —$NHCOOR^6$, —NHCO $R^6$, —OCONH $R_6$,—CONH $R^6$ (wherein, $R^6$ represents an alkyl group having 1~10 carbon atoms, or an aralkyl group having 7~15 carbon atoms), and the like.

Preferably, $R^2$ represents hydrogen atoms, unsubstituted alkyl groups having 1~8 carbon atoms, or unsubstituted aryl groups having 6~15 carbon atoms.

In the formulae (iii) or (iv), $R^3$, $R^4$, and $R^5$, respectively, may be the same or different, and each represent a single bond, or a bivalent linking group. As the linking group, aliphatic hydrocarbons, or aromatic hydrocarbons may be mentioned. The $R^3$, $R^4$, and $R^5$ may have a substituent, and examples of the substituent include an alkyl group, an aralkyl group, an aryl group, an alkoxy group, a halogen atom (—F, —Cl, —Br, —I and the lik), and the like.

The preferred examples of the $R^3$, $R^4$, and $R^5$ include unsustituted alkylene groups having 1~20 carbon atoms, unsubstituted arylene groups having 6~15 carbon groups, and the like, and more preferably, unsubstituted alkylene groups having 1~8 carbon atoms. Further, if necessary, $R^3$, $R^4$, and $R^5$ may have the other functional groups that do not react with the isocyanate group in the formula (ii) such as ester groups, urethane groups, amide groups, ureido groups, ether groups and the like.

Further, in $R^2$, $R^3$, $R^4$, and $R^5$, two or three thereof may bind each other to form a ring.

In the formula (iv), Ar represents a trivalent aromatic hydrocarbon which may have a substituent, preferably, an aromatic group having 6~15 carbon atoms.

The specific examples of the diisocyanate compound represented by the formula (ii) include as follows, but the invention is not limited thereto:

Aromatic diisocyanate compounds such as 2,4-tolylene diisocyanate, dimer of 2,4-tolylene diisocyanate, 2,6-tolylene diisocyanate, p-xylene diisocyanate, methaxylene diisocyanate, 4,4'-diphenylmethane diisocyanate, 1,5-naphthylene diisocyanate, 3,3'-dimethyl biphenyl-4,4'-diisocyanate, and the like; aliphatic diisocyanate compounds such as hexamethylene diisocyanate, trimethyl hexamethylene diisocyanate, lysine diisocyanate, dimer-acid diisocyanate, and the like; alicyclic diisocyanate compounds such as isophoron diisocyanate, 4,4'-metylenebis(cyclohexyl diisocyanate), methyl cyclohexane-2,4 (or 2,6) diisocyanate, 1,3-(isocyanatomethyl)cyclohexane, and the like; diisocyanate compounds that are reaction products of diols and diisocyanates such as adducts of 1 mol of 1,3-buthyleneglycol and 2 mol of tolylene diisocyanate, and the like.

As the diisocyanate compound, the diisocyanates having an aromatic ring such as 4,4'-diphenylmethane diisocyanate, xylene diisocyanate, tolylene diisocyanate, and the like are preferred from the viewpoint of scratching resistance.

Further, the specific examples of the diol compound having carboxyl groups represented by the formulae (iii) or (iv) include as follows, but the invention is not limited thereto:

3,5-Dihydroxy benzoic acid, 2,2-bis(hydroxymethyl)propionic acid, 2,2-bis(hydroxyethy)propionic acid, 2,2-bis(3-hydroxypropyl)propionic acid, 2,2-bis(hydroxymethyl)acetic acid, bis-(4-hydroxyphenyl) acetic acid, 4,4-bis-(4-hydroxyphenyl)pentanoic acid, tartaric acid, and the like.

As the diol compound having carboxyl groups, among these, 2,2-bis(hydroxymethyl)propionic acid, 2,2-bis(hydroxyethyl)propionic acid and the like are preferred from the viewpoint of reactivity with the isocyanate.

Further, the polyurethane resin may be prepared by using two or more of the diisocyanate compounds represented by the formula (ii) and diol compounds having carboxyl groups represented by the formulae (iii) or (iv), respectively.

In addintion to the diol compounds having carboxyl groups represented by the foumulae (iii) or (iv), diol compounds which do not have carboxyl group and may have a substituent which does not react with the isocyanate group in the formula (ii) may be used in combination in an amount not lowering alkali developing ability.

The polyurethane resin can be synthesized by adding a known catalyst which has a reactivity in response to the respective reaction compounds into a solution of the diisocyanate compound and diol compound in an aprotic solvent, and heating them.

Mole ratio of the diisocyanate and the diol compounds to be used is preferably 0.8: 1~1.2:1. When the isocyanate group remains on an end of the polymer, the remaining group is treated with alcohols or amines to obtain finally compounds in which the isocyanate group not remain.

Molecular weight of the polyurethane resin is preferably 1,000 or more on the basis of the weight average molecular weight, and more preferably, 5,000~100,000. The polyurethane resin may be used alone or two or more thereof may be used in combination.

Next, the water insoluble and alkali soluble polyvinyl acetal resin will be explained. The polyvinyl acetal resins to be used in the invention are not particularly limited as long as they are water insoluble and alkali soluble. Among these, polyvinyl acetal resin represented by the following formula (v) is preferred.

Formula (v)

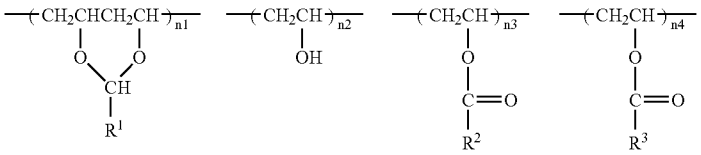

Structural unit (i) [n1 = 5~85 mol %] | Structural unit (ii) n2 = 0~60 mol % | Structural unit (iii) n3 = 0~20 mol % | Structural unit (iv) n4 = 3~60 mol %]

The polyvinyl acetal resin represented by the formula (v) contains at least one of the structural units (i)~(iv), in which a structural unit (i) that is a vinylacetal component and a structural unit (iv) that is an ester component having carboxyl groups are presented as essential components, and a structural unit (ii) that is a vinyl alcohol component and a structural unit (iii) that is an unsubstituted ester component are presented as optional components. n1~n4 represent a composition ratio (mole %) of the respective structural units.

In the structural unit (i), $R^1$ represents an alkyl group which may have a substituent, a hydrogen atom, carboxyl group, or a dimethylamino group. Examples of the substituent include a carboxyl group, a hydroxy group, a chloro group, a bromo group, an urethane group, an ureido group, a tertiary amino group, an alkoxy group, a cyano group, a nitro group, an amido group, an ester group, and the like.

The specific examples of $R^1$ in the structural unit (i) include a hydrogen atom, a methyl group, an ethyl group, a propyl group, a butyl group, a pentyl group, a carboxyl group, a halogen atom (—Br, —Cl, and the like) or a methyl group which is substituted with a cyano group, 3-hydorxybutyl group, 3-methoxybutyl group, a phenyl group, and the like, and among these, a hydrogen atom, a propyl group, a phenyl group and the like are preferred.

n1 is preferably in a range of 5~85 mole %, and more preferably, 25~70 mole %.

n2 is preferably in a range of 0~60 mole %, and more preferably, 10~45 mole %.

In the structural unit (iii), $R^2$ represents an alkyl group which does not have a substituent. Among these, an alkyl group having 1~10 carbon atoms is preferred, and methyl group and ethyl group are more preferred from the viewpoint of developing ability.

n3 is preferably in a range of 0~20 mole %, and more preferably, 1~10 mole %.

In the structural unit (iv), $R^3$ represents an aliphatic hydrocarbon, an alicyclic hydrocarbon, or an aromatic hydrocarbon, which have a carboxyl group. These hydrocarbons have preferably 1~20 carbon atoms. Further, these hydrocarbons in the structural unit (iv) are preferably hydrocarbons obtained by reacting anhydrides such as a succinic anhydride, a maleic anhydride, a phthalic anhydride, a trimellitic anhydride, cis-4-cyclohexene-1,2-dicarboxylic anhydride, and the like, with —OH which is remaining in the polyvinyl acetal. Among these, hydrocarbons obtained by reaction with a phthalic anhydride, a succinic anhydride, and the like are preferred. The hydrocarbons may be one obtained by using the other cyclic acid anhydrides.

$R^3$ in the structural unit (iv) may have substituents other than the carboxyl group. Examples of the substituents include groups of the following structures shown below:

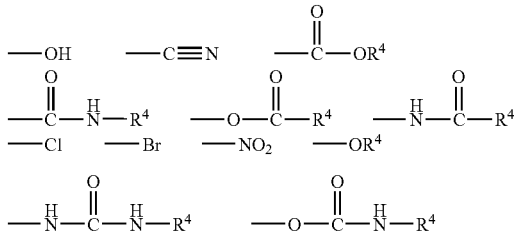

In the structures shown above, $R^4$ represents an alkyl group having 1~20 carbon atoms, an aralkyl group or aryl group, which may have a substituent, and examples of the substituent include —OH, —C≡N, —Cl, —Br, —$NO_2$, and the like.

The specific examples of $R^3$ in the structural unit (iv) include as follows, but the invention is not limited thereto:

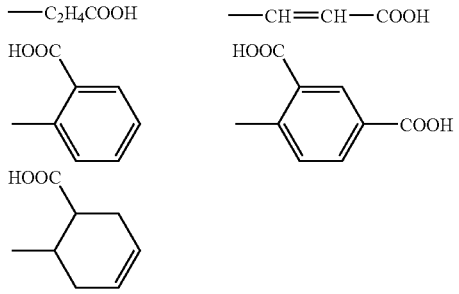

n4 is preferably in a range of 3~60 mole %, and more preferably, 10~55 mole %, from the viewpoint of developing ability.

The polyvinyl acetal resin represented by the formula (v) can be synthesized by acetallization of a polyvinyl alcohol with an aldehyde, and then, by reaction of the remaining hydroxy group with an acid anhydride.

Examples of the aldehyde include formaldehyde, acetaldehyde, propionaldehyde, butylaldehyde, pentylaldehyde, hexylaldehyde, glyoxylic acid, N,N-demethyl formamidodi-n-butyl acetal, bromoacetaldehyde, chloroacetaldehyde, 3-hydroxy-n-butylaldehyde, 3-methoxy-n-butylaldehyde, 3-(dimethylamino)-2,2-dimethyl propionaldehyde, cyanoacetaldehyde, and the like, but the invention is not limited thereto.

Content of acids in the polyvinyl acetal resin is preferably 0.5~5.0 meq/g (i.e., 84~280 expressed by mg of the KOH), and more preferably, 1.0~3.0 meq/g.

Molecular weight of the polyvinyl acetal resin is preferably about 5,000~400,000, and more preferably, about 20,000~300,000, based on the weight average molecular weight measured by Gel Permeation Chromatography. Further, these polyvinyl acetal resins may be used alone or two or more thereof may be used in combination.

The alkali soluble resin which is presented in the lower layer may be used alone or two or more thereof may be combined and used.

When the recording layer has a monolayer structure, content of the alkali soluble resin in the recording layer is preferably 30~99 mass % with respect to the total solid contents in the recording layer, and more preferably, 40~95 mass %, from the viewpoints of sensitivity and durability of the recording layer.

When the recording layer has multilayer structure, content of the alkali soluble resin in the outermost layer is preferably 40~98 mass %, and more preferably, 60~97 mass % with respect to the total solid contents in the outermost layer, from the viewpoints of sensitivity and durability of the recording layer.

Content of the alkali soluble resin in the lower layer is preferably 40~95 mass %, and more preferably, 50~90 mass % with respect to the total solid contents in the lower layer.

(Developing Inhibitor)

The recording layer of an embodiment in the invention is preferably blended with a developing inhibitor for the purpose of improving the inhibition (dissolution inhibiting ability). Particularly, when the recording layer is multilayer, the developing inhibitor is preferably contained in the outermost layer.

Any material may be used as the development inhibitor used in the invention without any particular limitation insofar as it interacts with the aforementioned alkali-soluble resin to substantially reduce the solubility of the alkali-soluble resin in a developer in the unexposed portion and allows the interaction to be weakened in the exposed portion so that the resin of the exposed portion is soluble in the developer. Particularly, a quaternary ammonium salt or a polyethylene glycol type compound is preferably used. Also, among image colorants, light to energy converting agent which will be described later, there are compounds which function as the developing inhibitor and these compounds are also given as preferable examples of the development inhibitor.

The quaternary ammonium salt is not particularly limited, and examples thereof include tetraalkylammonium salts, trialkylarylammonium salts, dialkyldiarylammonium salts, alkyltriarylammonium salts, tetaraarylammonium salts, cyclic ammonium salts, bicyclic ammonium salts, and the like.

The specific examples of the quaternary ammonium salt include tetrabutylammonium bromide, tetrapentylammonium bromide, tetrahexylammonium bromide, tetraoctylammonium bromide, tetralaurylammonium bromide, tetraphenylammonium bromide, tetranaphthylammonium bromide, tetrabutylammonium chloride, tetrabutylammonium iodide, tetrastearylammonium bromide, lauryltrimethylammonium bromide, stearyltrimethylammonium bromide, behenyltrimethylammonium bromide, lauryltriethylammonium bromide, phenyltrimethylammonium bromide, 3-trifluoromethylphenyltrimethylammonium bromide, benzyltrimethylammonium bromide, dibenzyldimethylammonium bromide, distearyldimethylammonium bromide, tristearylmethylammonium bromide, benzyltriethylammonium bromide, hydroxyphenyltrimethylammonium bromide, N-methylpyridinium bromide and the like. In particular, quaternary ammonium salts disclosed in JP-A Nos. 2003-167332 and 2003-107688 are preferred.

The amount of the quaternary ammonium salt to be added is preferably 0.1~50 mass % and more preferably 1~30 mass % based on the total solid content of the monolayer type recording layer from the viewpoint of development inhibitive effect and film-forming characteristics of the above alkali-soluble resin. Further, for the multilayer type recording layer, the amount of the quaternary ammonium salt to be added is preferably 0.1~50 mass % and more preferably 1~30 mass % based on the total solid contents of the outermost layer.

The polyethylene glycol compound is not particularly limited, and may be a compound represented by the following formula (vi):

$$R^{61}\text{—}\{\text{—O—}(R^{63}\text{—O—})_m\text{—}R^{62}\}_n \qquad \text{(vi)}$$

wherein $R^{61}$ represents a polyhydric alcohol residue or polyhydric phenol residue; $R^{62}$ represents a hydrogen atom, or an alkyl, alkenyl, alkynyl, alkyloyl, aryl or aryloyl group which may each have a substituent and each have 1 to 25 carbon atoms; $R^{63}$ represents an alkylene group which may have a substituent; m is an integer of 10 or more on average and n is an integer of 1~4 on average.

Examples of the polyethylene glycol compound represented by the formula (vi) include polyethylene glycols, polypropylene glycols, polyethylene glycol alkyl ethers, polypropylene glycol alkyl ethers, polyethylene glycol aryl ethers, polypropylene glycol aryl ethers, polyethylene glycol alkylaryl ethers, polypropylene glycol alkylaryl ethers, polyethylene glycol glycerin esters, polypropylene glycol glycerin esters, polyethylene sorbitol esters, polypropylene glycol sorbitol esters, polyethylene glycol aliphatic acid esters, polypropylene glycol aliphatic acid esters, polyethylene glycolated ethylenediamines, polypropylene glycolated ethylenediamines, polyethylene glycolated diethylenetriamines, polypropylene glycolated diethylenetriamines, and the like.

Specific examples of the polyethylene glycol compounds include polyethylene glycol 1000, polyethylene glycol 2000, polyethylene glycol 4000, polyethylene glycol 10000, polyethylene glycol 20000, polyethylene glycol 5000, polyethylene glycol 100000, polyethylene glycol 200000, polyethylene glycol 500000, polypropylene glycol 1500, polypropylene glycol 3000, polypropylene glycol 4000, polyethylene glycol methyl ether, polyethylene glycol ethyl ether, polyethylene glycol phenyl ether, polyethylene glycol dimethyl ether, polyethylene glycol diethyl ether, polyethylene glycol diphenyl ether, polyethylene glycol lauryl ether, polyethylene glycol dilauryl ether, polyethylene glycol nonyl ether, polyethylene glycol cetyl ether, polyethylene glycol stearyl ether, polyethylene glycol distearyl ether, polyethylene glycol behenyl ether, polyethylene glycol dibehenyl ether, polypropylene glycol methyl ether, polypropylene glycol ethyl ether, polypropylene glycol phenyl ether, polypropylene glycol dimethyl ether, polypropylene glycol diethyl ether, polypropylene glycol diphenyl ether, polypropylene glycol lauryl ether, polypropylene glycol dilauryl ether, polypropylene glycol nonyl ether, polyethylene glycol acetyl ester, polyethylene glycol diacetyl ester, polyethylene glycol benzoate, polyethylene glycol lauryl ester, polyethylene glycol dilauryl ester, polyethylene glycol nonylate, polyethylene glycol cetylate, polyethylene glycol stearoyl ester, polyethylene glycol distearoyl ester, polyethylene glycol behenate, polyethylene glycol dibehenate, polypropylene glycol acetyl ester, polypropylene glycol diacetyl ester, polypropylene glycol benzoate, polypropylene glycol dibenzoate, polypropylene glycol laurate, polypropylene glycol dilaurate, polypropylene glycol nonylate, polyethylene glycol glycerin ether, polypropylene glycol glycerin ether, polyethylene glycol sorbitol ether, polypropylene glycol sorbitol ether, polyethylene glycolated ethylenediamine, polypropylene glycolated ethylendiamine, polyethylene glycolated diethylenetriamine, polypropylene glycolated diethylenetriamine, polyethylene glycolated pentamethylenehexamine, and the like.

The amount of the polyethylene glycol compound to be added is preferably 0.1 to 50 mass % and more preferably 1 to 30 mass % based on the total solid contents of the monolayer type recording layer from the viewpoint of development inhibitive effect and film forming ability. For the multilayer type recording layer, the amount of the polyethylene glycol compound to be added is preferably 0.1 to 50 mass % and more preferably 1 to 30 mass % based on the total solid contents of the outermost layer.

Moreover, in the such a case of increasing the inhibition (dissolution inhibiting ability), lower of sensitivity may be occured. However, to suppress the lower of sensitivity, lactone compounds which are described in JP-A No. 2002-361066 are added effectively to the outermost layer.

Further, it is desirable to use in combination a substance that is thermally decomposable and that substantially lowers the solubility of the alkali-soluble resin in an undecomposed state, such as onium salts, o-quinonediazide compounds, aromatic sulfone compounds and aromatic sulfonate compounds, in order to improve the inhibition of image areas to a developer.

Examples of the onium salts used in the invention include diazonium salts, ammonium salts, phosphonium salts, iodonium salts, sulfonium salts, selenonium salts, and arsonium salts. Particularly preferable examples thereof include diazonium salts described in S. I. Schlesinger, Photogr. Sci. Eng., 18, 387 (1974), T. S. Bal et al., Polymer, 21, 423 (1980), and JP-A No. 5-158230; ammonium salts described in U.S. Pat. Nos. 4,069,055 and 4,069,056, and JP-A No. 3-140140; phosphonium salts described in D. C. Necker et al, Macromolecules, 17, 2468 (1984), C. S. Wen et al., Teh, Proc. Conf. Rad. Curing ASIA, p. 478, Tokyo, Oct. (1988), and U.S. Pat. Nos. 4,069,055 and 4,069,056; iodonium salts described in J. V. Crivello et al., Macromolecules, 10(6), 1307 (1977), Chem. & Eng. News, Nov. 28, p. 31 (1988), EP No. 104,143, U.S. Pat. Nos. 5,041,358, 4,491,628, and JP-A Nos. 2-150848 and 2-296514; sulfonium salts described in J. V. Crivello et al., Polymer J. 17, 73 (1985), J. V. Crivello et al., J. Org. Chem., 43, 3055 (1978), W. R. Watt et al., J. Polymer Sci., Polymer Chem. Ed., 22, 1789 (1984), J. V. Crivello et al., Polymer Bull., 14, 279 (1985), J. V. Crivello et al., Macromolecules, 14 (5), 1141 (1981), J. V. Crivello et al., J. Polymer Sci., Polymer Chem. Ed., 17, 2877 (1979), EP Patent Nos. 370,693; 233,567; 297,443 and 297,442, U.S. Pat. Nos. 4,933,377; 3,902,114; 4,491,628; 4,760,013; 4,734,444 and 2,833,827, and DE Patents Nos. 2,904,626; 3,604,580; 3,604,581; selenonium salts described in J. V. Crivello et al., Macromolecules, 10 (6), 1307 (1977), J. V. Crivello et al., J. Polymer Sci., Polymer Chem. Ed., 17, 1047 (1979); and arsonium slats described in C. S. Wen et al., Teh, Proc. Conf. Rad. Curing ASIA p. 478 Tokyo, October (1988).

Of these onium salts, diazonium salts are particularly preferable. Particularly preferable examples of the diazonium salts include salts described in JP-A No. 5-158230.

Examples of the counter ion for the onium salt include anions of tetrafluoroboric acid, hexafluorophosphoric acid, triisopropylnaphthalenesulfonic acid, 5-nitro-o-toluenesulfonic acid, 5-sulfosalicylic acid, 2,5-dimethylbenzenesulfonic acid, 2,4,6-trimethylbenzenesulfonic acid, 2-nitrobenzenesulfonic acid, 3-chlorobenzenesulfonic acid, 3-bromobenzenesulfonic acid, 2-fluorocaprylnaphthalenesulfonic acid, dodecylbenzenesulfonic acid, 1-naphthol-5-sulfonic acid, 2-methoxy-4-hydroxy-5-benzoyl-benzenesulfonic acid, and paratoluenesulfonic acid, and the like. Among these, anions of hexafluorophosphoric acid and alkylaromatic sulfonic acids, such as triisopropylnaphthalenesulfonic acid and 2,5-dimethylbenzenesulfonic acid, are particularly preferred.

The quinonediazide compounds are preferably o-quinonediazide compounds. The o-quinonediazide compounds are compounds which each have at least one o-quinonediazide group and each have alkali-solubility increased by being thermally decomposed, and which may have various structures. In other words, the o-quinonediazide compounds assist the dissolution of the outermost layer by both of the effect that the compounds are thermally decomposed so that their inhibition for the developing inhibitor is lost and the effect that the o-quinonediazide compounds themselves change to alkali-soluble substances.

Such an o-quinonediazide compound may be, for example, a compound described in J Cohser "Light-Sensitive Systems" (John & Wiley & Sons. Inc.), pp. 339-352. Particularly preferable is a sulfonic ester or sulfonic amide of o-quinonediazide, which is obtained by reacting the o-quinonediazide with an aromatic polyhydroxy compound or aromatic amino compound. Preferable are also an ester made from benzoquinone-(1,2)-diazidesulfonic chloride or naphthoquinone-(1,2)-diazido-5-sulfonic chloride and pyrogallol-acetone resin, described in JP-B No. 43-28403; an ester made from benzoquinone-(1,2)-diazidoesulfonic chloride or naphthoquinone-(1,2)-diazido-5-sulfonic chloride and phenol-formaldehyde resin, described in U.S. Pat. Nos. 3,046,120 and 3,188,210.

Furthermore, preferable are an ester made from naphthoquinone-(1,2)-diazido-4-sulfonic chloride and phenol formaldehyde resin or cresol-formaldehyde resin, and an ester made from naphthoquinone-(1,2)-diazido-4-sulfonic chloride and pyrogallol-acetone resin. Other useful o-quinonediazide compounds are reported and disclosed in many examined or unexamined patent documents, for example, JP-A Nos. 47-5303, 48-63802, 48-63803, 48-96575, 49-38701 and 48-13354, JP-B Nos. 41-11222, 45-9610 and 49-17481, U.S. Pat. Nos. 2,797,213; 3,454,400; 3,544,323; 3,573,917; 3,674,495 and 3,785,825, GB Patents Nos. 1,227,602; 1,251,345; 1,267,005; 1,329,888 and 1,330,932, and DE Patent No. 854,890.

The amount of the o-quinonediazide compound to be added is preferably in a range from 1 to 50 mass %, and more preferably in a range from 5 to 30 mass % based on the total solid contents of the monolayer type recording layer. For the multilayer type recording layer, the amount of the o-quinonediazide compound to be added is preferably in a range from 1 to 50 mass %, and more preferably in a range from 5 to 30 mass % and particularly preferably in a range from 10 to 30 mass % based on the total solid content of the outermost layer. These compounds may be used alone or two or more thereof may be used in combination.

In order to strengthen the inhibition on the surface of the recording layer and to strengthen scratch resistance on the surface, it is desirable to use in combination a polymer containing, as a polymerization component, a (meth)acrylate monomer which has two or three perfluoroalkyl groups having 3 to 20 carbon atoms in the molecule, as disclosed in JP-A No. 2000-187318.

The amount of the polymer to be added is preferably 0.1~10 mass %, and more preferably, 0.5~5 mass % based on the total solid contents of the monolayer type recording layer. For the multilayer type recording layer, the amount of the polymer to be added is preferably 0.1~10 mass %, and more preferably, 0.5~5 mass % based on the total solid contents of the outermost layer.

(Infrared Absorbent)

The recording layer in the invention comprises infrared absorbents.

The planographic printing plate precursor of the invention comprises an infrared absorbent which has absorption maximum at an infrared region and has light-heat conversion ability, thereby recording by an infrared laser can be attained.

The infrared absorbent used in the invention is not particularly limited as long as it is dyes which adsorbs infrared light or near infrared light to generate heat, and various dyes which have been known as infrared absorbents may be used.

When the recording layer has the multilayer structure, the infrared absorbent may be contained in at least one of a layer closest to the support (lower layer) and a layer farthest from the support (outermost layer). The infrared absorbent may be contained in both of the lower layer and the outermost layer.

The infrared absorbents include commercially available dyes and publicly known dyes described in literature (e.g., "Dye manual", the Society of Synthetic Organic Chemistry, Japan Ed., 1970). Specific examples thereof include azo dyes, metal complex salt azo dyes, pyrazolone azo dyes, anthraquinone dyes, phthalocyanine dyes, carbonium dyes, quinonimine dyes, methine dyes, cyanine dyes and the like. Among these dyes, dyes absorbing an infrared light or dyes absorbing a near-infrared light are particularly preferable, as they are suitable for use together with a laser emitting the infrared light or near-infrared light.

Typical examples of these dyes include cyanine dyes described in JP-A Nos. 58-125246, 59-84356, 59-202829 and 60-78787, and U.S. Pat. No. 4,973,572; methine dyes described in JP-A Nos. 58-173696, 58-181690, and 58-194595, and others; naphthoquinone dyes described in JP-A Nos. 58-112793, 58-224793, 59-48187, 59-73996, 60-52940, and 60-63744, and others; squarylium dyes described in JP-A No. 58-112792 and others; cyanine dye described in U.K. Patent No. 434,875; and the like.

Preferable examples of the dyes include near infrared-absorbing sensitizers described in U.S. Pat. No. 5,156,938; arylbenzo(thio)pyrylium salts described in U.S. Pat. No. 3,881,924; trimethine thiapyrylium salts described in JP-A No. 57-142645(corresponding U.S. Pat. No. 4,327,169); pyrylium compounds described in JP-A Nos. 58-181051, 58-220143, 59-41363, 59-84248, 59-84249, 59-146063, and 59-146061; cyanine dyes described in JP-A No. 59-216146; pentamethine thiopyrylium salts and the iike described in U.S. Pat. No. 4,283,475; pyrylium compounds and the like described in JP-B Nos. 5-13514 and 5-19702; commercial products such as Epolight III-178, Epolight III-130, and Epolight III-125 manufactured by Epolin, Inc.; and the like.

Other preferable examples of the dyes include near infrared-absorbing dyes represented by Formulae (I) and (II) described in U.S. Pat. No. 4,756,993.

Among these dyes, the preferred example thereof include cyanine dyes, sqalilium dyes, pyrylium salt, nickel thiolate complex, indolenine cyanine dyes, and the like. More preferably, cyanine dyes, indolenine cyanine dyes and the like, still more preferably, cyanine dyes of the following formula (a):

Formula (a)

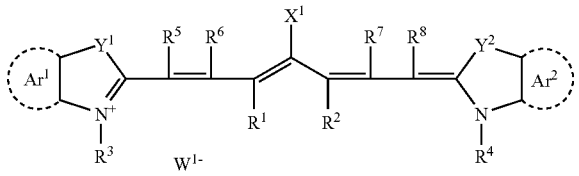

In the formula (a), $X^1$ represents a hydrogen atom, a halogen atom, —$NPh_2$, $X^2$—$L^1$ or a group of the following formula (b), wherein $X^2$ is an oxygen atom, a nitrogen atom, or a sulfur atom, and $L^1$ is a hydrocarbon group having 1~12 carbon atoms, an aromatic ring having a hetero atom, or a hydrocarbon group having a hetero atom and 1~12 carbon atoms. The hetero atom represents N, S, O, a halogen atom, or Se. $W^{1-}$ has the same definition for $Xa^-$ described below. In the formula (b), $R^a$ is a substituent selected from the group consisting of a hydrogen atom, an alkyl group, an aryl group, a substituted or unsubstituted amino group, and a halogen atom.

Formula (b)

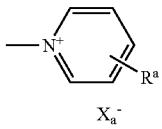

In the formula (a), $R^1$ and $R^2$ are respectively a hydrocarbon group having 1~12 carbon atoms. From the viewpoint of preservation stability of the coating solution for the recording layer, $R^1$ and $R^2$ are preferably a hydrocarbon group having 2 or more carbon atoms. Further, $R^1$ and $R^2$ are preferably combined each other to form a 5- or 6-membered ring.

$Ar^1$ and $Ar^2$ may be same or different, and represent respectively an aromatic hydrocarbon group that may have a substituent. The preferred aromatic hydrocarbon group includes a benzene ring and a naphthalene group. Further, examples of the substituent include a hydrocarbon group having 12 or less carbon atoms, a halogen atom, an alkoxy group having 12 or less carbon atoms, and the like. $Y^1$ and $Y^2$ may be same or different, and represent respectively a sulphur atom, or a dialkylmethylene group having 12 or less carbon atoms. $R^3$ and $R^4$ may be same or different, and represent respectively a hydrocarbon group having 20 or less carbon atoms, which may have a substituent. Examples of the substituent include an alkoxy group having 12 or less carbon atoms, a carboxyl group and a sulfo group. $R^5$, $R^6$, $R^7$ and $R^8$ may be same or different, respectively, and represent respectively a hydrogen atom or a hydrocarbon group having 12 or less carbon atoms. From the viewpoint of availability of the raw materials, a hydrogen atom is preferable. Further, $Xa^-$ represents a counter anion. Provided that, if the cyanine dye represented by the formula (a) has an anionic substituent in the structure and no charge neutralization is needed, $W^{1-}$ is unnecessary. Preferable $Xa^-$ includes a halogen ion, a perchlorinate ion, a tetrafluoroborate ion, a hexafluorophosphate ion, and sulfonate ion, from the viewpoint of preservation stability of the coating solution for the recording layer. More preferably, $Xa^-$ includes a perchlorinate ion, a hexafluorophosphate ion, and an arylsulfonate ion.

In the case of the multilayer type recording layer, the infrared absorbent may be contained in the outermost layer of the recording layer or near the layer. Particularly, a substance having a dissolution inhibiting ability such as a cyanine dye is added in combination with an alkali soluble resin having a phenol group, thereby high sensitivity can be obtained together with resistance to alkali dissolution in the unexposed portion. Further, these infrared absorbents may be added to the lower layer, or both the lower layer and the outermost layer. It is possible to improve further high sensitivity by adding to the lower layer. When the infrared absorbents are added to both the lower layer and the outermost layer, they may be same or different each other.

Moreover, the infrared absorbent may be added to a layer formed separately in addition to the recording layer. In the case of adding to the separate layer, it is preferable to add the infrared absorbent to a layer adjacent to the recording layer.

The amount of the infrared absorbent to be added is preferably 3~50 mass %, and more preferably, 5~40 mass % based on the total solid content of the recording layer, for the monolayer type recording layer. In the multilayer type recording layer, the amount of the infrared absorbent to be added to the outermost layer thereof is preferably 0.0150 mass % and more preferably 0.1~30 mass %, and particularly preferably, 1.0~30 mass % based on the total solid content of the outermost layer. If the addition amount is within the range described above, sensitivity and durability of the recording layer become good. Further, when the infrared absorbent is added to the lower layer, the amount to be added is preferably 0~20 mass % and more preferably, 0~10 mass % and still more preferably, 0~5 mass % based on the total solid content of the lower layer.

When the infrared absorbent is added to the lower layer, use of an infrared absorbent having an ability of the dissolution inhibition enables to reduction of the solubility of the lower layer. On the other hand, the infrared absorbent generates heat upon exposing to an infrared laser, whereby the generated heat can expect to increase the solubility of the lower layer. As a result, the type and amount of the compounds to be added may be selected depending on the balance thereof. Further, the generated heat is diffused to the support near the area of 0.2~0.3 μm, and it is therefore difficult to obtain an effect of improvement in the solubility due to the heat and decrease of the solubility of the lower layer due to the addition of the infrared absorbent cause to lower of the sensitivity. Accordingly, such an addition amount that falls below 30 nm/sec of velocity of dissolution on the developing solution (25~30° C.) of the lower layer is not preferable among the range of the addition amount described above.

(Other Additives)

Upon forming the recording layer, various kinds of additives may further be added, as needed, in addition to the essential components mentioned above, as long as the effect of the invention is not thereby impaired.

For the multilayer type recording layer, the following additives may be added only to the lower layer, only to the outermost layer, or to both the lower layer and the outermost layer.

(Development Accelerator)

For improvement in sensitivity, an acid anhydride, a phenol compound and an organic acid may be added to the recording layer of the invention.

As the acid anhydride, cyclic acid anhydrides are preferred. Specific examples of the cyclic acid anhydrides include phthalic anhydride, tetrahydrophthalic anhydride, hexahydrophihalic anhydride, 3,6-endoxy-tetrahydrophthalic anhydride, tetrachlorophthalic anhydride, maleic anhydride, chloromaleic anhydride, α-phenylmaleic anhydride, succinic anhydride and pyromellitic anhydride as described in U.S. Pat. No. 4,115,128. Examples of acyclic acid anhydrides include acetic anhydrides.

Examples of the phenols include bisphenol A, 2,2'-bishydroxysulfone, 4,4'-bishydroxysulfone, p-nitrophenol, p-ethoxyphenol, 2,4,4'-trihydroxybenzophenone, 2,3,4-trihydroxybenzophenone, 4-hydroxybenzophenone, 4,4',4"-trihydroxytriphenylmethane, 4,4',3",4"-tetrahydroxy-3,5,3',5'-tetramethyltriphenylmethane, and the like.

Additionally, examples of the organic acids include the sulfonic acids, sulfinic acids, alkylsulfuric acids, phosphonic acids, phosphoric acid esters and carboxylic acids described in JP-A Nos. 60-88942 and 2-96755, and others, and specific examples thereof include p-toluenesulfonic acid, dodecylbenzenesulfonic acid, p-toluenesulfinic acid, ethylsulfuric acid, phenylphosphonic acid, phenylphosphinic acid, phenyl phosphate, diphenyl phosphate, benzoic acid, isophthalic acid, adipic acid, p-toluic acid, 3,4-dimethoxybenzoic acid, phthalic acid, terephthalic acid, 4-cyclohexene-1,2-dicarboxylic acid, erucic acid, lauric acid, n-undecane acid, ascorbic acid, and the like.

The content of the acid anhydride, the phenol compound and the organic acid in the recording layer is preferably from 0.05 to 20 mass %, more preferably from 0.1 to 15 mass %, and particularly preferably from 0.1 to 10 mass %, based on the total solid contents of the monolayer-type recording layer. For the multilayer type recording layer, the content of the acid anhydride, the phenol compound and the organic acid in the lower layer or the outermost layer is preferably from 0.05 to 20 mass %, more preferably from 0.1 to 15 mass %, and particularly preferably from 0.1 to 10 mass %, based on the total solid contents.

(Surfactant)

For improvement of coatability and enhancement of processing stability with respect to developing conditions, the recording layer of the invention may contain a nonionic surfactant such as those disclosed in JP-A Nos. 62-251740 and 3-208514, an amphoteric surfactant such as those disclosed in JP-A Nos. 59-121044 and 4-13149, a siloxane compound such as those disclosed in EP-A No. 950517, and a copolymer of fluorine-containing monomers as disclosed in JP-A Nos. 62-170950, 11-288093 and 2003-057820.

The content of the surfactant in the monolayer-type recording layer is preferably 0.01 to 15 mass %, more preferably 0.1 to 5 mass %, and still more preferably 0.05 to 0.5 mass %, based on the total solid contents of the monolayer-type recording layer.

For the multilayer type recording layer, the content of the surfactant in the lower layer or the outermost layer is preferably 0.01 to 15 mass %, more preferably 0.1 to 5 mass %, and still more preferably 0.05 to 2 mass %, based on the total solid contents.

(Printing-Out Agent/Coloring Agent)

The recording layer of the invention may contain a printing-out agent for obtaining visible images immediately after heating by exposure, and a dye and a pigment may be added as an image coloring agent.

A typical example of the printing-out agent is a combination of a compound which releases an acid by being heated by exposure to light (optically acid-releasing agent)

with an organic dye which can form a salt. Specific examples thereof include combinations of o-naphthoquinonediazido-4-sulfonic acid halogenide with a salt-formable organic dye, described in JP-A Nos. 50-36209 and 53-8128; and combinations of a trihalomethyl compound with a salt-formable organic dye, described in JP-A Nos. 53-36223, 54-74728, 60-3626, 61-143748, 61-151644 and 63-58440. The trihalomethyl compound is an oxazole type compound or a triazine type compound. Either of these compounds are excellent in stability over time and can give vivid printed-out images.

The image coloring agent may be the above-mentioned salt-formable organic dye or some other dye than the salt-formable organic dye, and is preferably an oil-soluble dye or a basic dye. Specific examples thereof include Oil Yellow #101, Oil Yellow #103, Oil Pink #312, Oil Green BG, Oil Blue BOS, Oil Blue #603, Oil Black BY, Oil Black BS, and Oil Black T-505 (trade name, manufactured by Orient Chemical Industries Ltd.), Victoria Pure Blue, Crystal Violet Lactone, Crystal Violet (CI42555), Methyl Violet (CI42535), Ethyl Violet, Rhodamine B (CI145170B), Malachite Green (CI42000), and methylene Blue (CI52015). Dyes described in JP-A No. 62-293247 are particularly preferable.

These dyes may be added to the monolayer-type recording layer in an amount of 0.01 to 10 mass %, and preferably from 0.1 to 3 mass %, based on the total solid contents of the recording layer. For the multilayer type recording layer, the dyes may add in an amount of 0.01 to 10 mass %, and preferably from 0.1 to 3 mass %, based on the total solid contents of the lower layer or the outermost layer.

(Plasticizer)

The recording layer may contain a plasticizer for imparting flexibility to a coated film. Examples thereof include butylphthalyl, polyethylene glycol, tributyl citrate, diethyl phthalate, dibutyl phthalate, dihexyl phthalate, dioctyl phthalate, tricresyl phosphate, tributyl phosphate, trioctyl phosphate, tetrahydrofurfuryl oleate and an oligomer or a polymer of acrylic acid or methacrylic acid.

The plasticizer may be added to the monolayer-type recording layer in an amount of 0.5 to 10 mass %, and preferably 1.0 to 5 mass %, based on the total solid contents of the monolayer-type recording layer. For the multilayer type recording layer, the plsticizer may be added in an amount of 0.5 to 10 mass %, and preferably 1.0 to 5 mass %, based on the total solid contents of the lower layer or the outermost layer.

(Wax)

To the outermost layer of the monolayer-type or multilayer-type recording layer of the invention, wax as a compound that lowers a static friction coefficient of the surface may be added in order to impart scratch resistance. Specific examples of the wax include compounds having an ester of a long-chain alkyl carboxylic acid as disclosed in U.S. Pat. No. 6,117,913 and JP-A No. 2004-012770.

The amount of the wax added is preferably 0.1 to 10 mass %, and more preferably 0.5 to 5 mass %, based on the total solid contents of the monolayer-type recording layer. For the multilayer type recording layer, the amount of the wax added is preferably 0.1 to 10 mass %, and more preferably 0.5 to 5 mass %, based on the total solid contents of the outermost layer.

(Formation of Recording Layer)

The recording layer of the planographic printing plate precursor may be formed generally by dissolving the above components in at least one solvent to prepare a coating solution for the recording layer, and by applying the coating solution onto a proper support.

Examples of the solvent that may be used herein include ethylene dichloride, cyclohexanone, methyl ethyl ketone, methanol, ethanol, propanol, ethylene glycol monomethyl ether, 1-methoxy-2-propanol, 2-methoxyethyl acetate, 1-methoxy-2-propyl acetate, dimethoxyethane, methyl lactate, ethyl lactate, N,N-dimethyl acetamide, N,N-dimethyl formamide, tetramethyl urea, N-methyl pyrrolidone, dimethyl sulfoxide, sulfolane, γ-butyrolactone and toluene, but the invention is not limited thereto. These solvents may be used alone or in combination of two or more thereof.

In the case of the multilayer-type recording layer, it is desirable, in principle, to form the lower layer and the upper layer separately from each other.

Examples of the method for forming the two layers separately include a method that utilizes a difference in solubility in the solvent between the components contained in the lower layer and the components contained in the outermost layer, and a method in which the outermost layer is coated and then quickly dried to remove the solvent.

In order to impart a new function, the lower layer and the outermost layer may be partially admixed to such an extent that the effect of the invention remains sufficiently exhibited. The partial admixture can be achieved by controlling the difference in solubility in solvent or controlling the drying rate of the solvent after applying the outermost layer.

The concentration of the above components other than the solvent (total solid content including the additives) in the recording layer coating solution to be coated on the support is preferably 1 to 50 mass %.

There are various possible methods for applying the coating solution onto the support. Examples thereof include bar coater coating, spin coating, spray coating, curtain coating, dip coating, air knife coating, blade coating and roll coating.

In the case of the multilayer-type recording layer, in order to prevent the lower layer from being damaged upon coating the upper layer, the coating method is preferably a non-contact coating method. Bar coater coating, which is generally used for a solvent-based coating, despite being a contact method may be used. The bar coater coating is desirably effected by forward rotation in order to prevent damage to the lower layer.

The amount of the components of the recording layer to be applied in the monolayer type recording layer is preferably in a range of 0.3 to 3.0 g/m$^2$ and more preferably in a range of 0.5 to 2.5 g/m$^2$ after dried.

The amount of the components of the lower layer to be applied in the multilayer type recording layer is preferably in a range of 0.5 to 4.0 g/m$^2$ and more preferably in a range of 0.6 to 2.5 g/m$^2$ after dried. When the applied amount is 0.5 g/m$^2$ or more, printing durability is excellent, and when the applied amount is 4.0 g/m$^2$ or less, good image reproducibility and sensitivity can be attained.

Further, the amount of the components of the outermost layer to be applied is preferably in a range of 0.05 to 1.0 g/m$^2$ and more preferably in a range of 0.08 to 0.7 g/m$^2$ after dried. When the applied amount is 0.05 g/m$^2$ or more, good developing latitude and resistance to the scratching can be obtained, and when the applied amount is 1.0 g/m$^2$ or less, good sensitivity can be obtained.

The total amount of the components of the outermost layer and lower layer to be applied is preferably in a range of 0.6 to 4.0 g/m$^2$ and more preferably in a range of 0.7 to 2.5 g/m$^2$ after dried. When the total amount is 0.6 g/m$^2$ or more, good printing durability can be obtained, and when the total amount is 4.0 g/m$^2$ or less, good image reproducibility and sensitivity can be obtained.

[Support]

The support which is used in the planographic printing plate precursors of the invention may be any plate-form product that has necessary strength and endurance and is dimensionally stable. Examples thereof include a paper sheet; a paper sheet on which a plastic (such as polyethylene, polypropylene, or polystyrene) is laminated; a metal plate (such as an aluminum, zinc, or copper plate), a plastic film (such as a cellulose diacetate, cellulose triacetate, cellulose propionate, cellulose lactate, cellulose acetate lactate, cellulose nitrate, polyethylene terephthalate, polyethylene, polystyrene, polypropylene, polycarbonate, or polyvinyl acetal film); and a paper or plastic film on which a metal as described above is laminated or vapor-deposited.

Of these supports, a polyester film or an aluminum plate is preferable in the invention. An aluminum plate is particularly preferable since the plate is good in dimensional stability and relatively inexpensive. Preferable examples of the aluminum plate include a pure aluminum plate, and alloy plates comprising aluminum as the main component and a trace of different elements. A plastic film on which aluminum is laminated or vapor-deposited may be used. Examples of the different elements contained in the aluminum alloy include silicon, iron, manganese, copper, magnesium, chromium, zinc, bismuth, nickel, and titanium. The content by percentage of the different elements in the alloy is at most 10 mass %.

In the invention, pure aluminum is particularly preferable. However, completely pure aluminum is not easily produced from the viewpoint of metallurgy technology. Thus, aluminum containing a trace of the different elements may be used.

In the aluminum plate as described above, the composition is not specified, any aluminum plate that has been known or used hitherto may be appropriately used. The thickness of the aluminum plate used in the invention is generally about 0.1 to 0.6 mm, preferably 0.15 to 0.4 mm, and more preferably 0.2 to 0.3 mm.

The aluminum plate may be subjected to a surface treatment, such as a surface roughening treatment and an anodic oxidation treatment, if necessary. The surface treatment will be described below.

Before the surface of the aluminum plate is roughened, the plate is subjected to degreasing treatment with a surfactant, an organic solvent, an aqueous alkaline solution or the like if desired, in order to remove rolling oil on the surface. The roughening treatment of the aluminum plate surface is performed by any one of various methods, for example, by a mechanically surface-roughening method, or a method of dissolving and roughening the surface electrochemically, or a method of dissolving the surface selectively in a chemical manner.

The mechanically surface-roughening method which can be used may be a known method, such as a ball polishing method, a brush polishing method, a blast polishing method or a buff polishing method. The electrochemically surface-roughening method may be a method of performing surface-roughening in a hydrochloric acid or nitric acid electrolyte by use of alternating current or direct current. As disclosed in JP-A No. 54-63902, a combination of the two may be used.

The aluminum plate the surface of which is roughened as described above is subjected to alkali-etching treatment and neutralizing treatment if necessary. Thereafter, the aluminum plate is subjected to anodizing treatment if desired, in order to improve the water holding ability or wear resistance of the surface. The electrolyte used in the anodizing treatment of the aluminum plate is any one selected from various electrolytes which can make a porous oxide film. There is generally used sulfuric acid, phosphoric acid, oxalic acid, chromic acid, or a mixed acid thereof. The concentration of the electrolyte may be appropriately decided depending on the kind of the electrolyte.

Conditions for the anodizing treatment cannot be specified without reservation since the conditions vary depending on the electrolyte used. The following conditions are generally suitable: an electrolyte concentration of 1 to 80 mass %, a solution temperature of 5 to 70° C., a current density of 5 to 60 A/dm$^2$, a voltage of 1 to 100 V, and an electrolyzing time of 10 seconds to 5 minutes. If the amount of the anodic oxide film is less than 1.0 g/m$^2$, the printing durability is insufficient or non-image areas of the planographic printing plate are easily injured so that the so-called "injury stains", resulting from ink adhering to injured portions at the time of printing, are easily generated.

If necessary, the aluminum surface is subjected to treatment for hydrophilicity after the anodizing treatment.

The treatment for hydrophilicity which can be used in the invention may be an alkali metal silicate (for example, aqueous sodium silicate solution) method, as disclosed in U.S. Pat. Nos. 2,714,066, 3,181,461, 3,280,734, and 3,902,734. In this method, the support is subjected to immersing treatment or electrolyzing treatment with aqueous sodium silicate solution. Besides, there may be used a method of treating the support with potassium fluorozirconate disclosed in JP-B No. 36-22063 or with polyvinyl phosphonic acid, as disclosed in U.S. Pat. Nos. 3,276,868, 4,153,461, and 4,689,272.

(Organic Undercoat Layer)

The planographic printing plate precursor may be provided with an organic undercoat layer between the support and the recording layer as need.

As components for the organic undercoat layer, various organic compounds may be used. Examples thereof include carboxymethylcellulose, dextrin, gum arabic, phosphonic acids having an amino group such as 2-aminoethylphosphonic acid, organic phosphonic acids such as phenylphosphonic acid, naphthylphosphonic acid, alkylphosphonic acid, glycerophosphonic acid, methylenediphosphonic acid and ethylenediphosphonic acid, each of which may have a substituent, organic phosphoric acids such as phenylphosphoric acid, naphthylphosphoric acid, alkylphosphoric acid and glycerophosphoric acid, each of which may have a substituent, organic phosphinic acids such as phenylphosphinic acid, naphthylphosphinic acid, alkylphosphinic acid, and glycerophosphinic acid, each of which may have a substituent, amino acids such as glycine and β-alanine, and hydrochlorides of amines having a hydroxy group, such as hydrochloride of triethanolamine. These may be used in a mixture form.

Also, the organic undercoat layer preferably contains a compound having an onium group. The compound having an onium salt is described in detail in each publication of JP-A Nos. 2000-10292, 2000-108538 and 2000-241962.

Also, besides the above compounds, at least one compound selected from polymers having a structural unit represented by a poly(p-vinylbenzoic acid) may be used. Specific examples thereof include copolymers of a p-vinyl-benzoic acid and a vinylbenzyltriethylammonium chloride and copolymers of a p-vinylbenzoic acid and a vinylbenzyltrimethylammonium salt.

This organic undercoat layer can be formed by the following method: a method of dissolving the above-mentioned organic compound into water, an organic solvent such as methanol, ethanol or methyl ethyl ketone, or a mixed solvent thereof to prepare a solution, applying the solution onto an aluminum plate, and drying the solution to form the undercoat layer; or a method of dissolving the above-mentioned organic compound into water, an organic solvent such as methanol, ethanol or methyl ethyl ketone, or a mixed solvent thereof to prepare a solution, dipping an aluminum plate into the solution to cause the plate to adsorb the organic compound, washing the plate with water or the like, and then drying the plate to form the organic undercoat layer.

In the former method, the solution of the organic compound having a concentration of 0.005 to 10 mass % can be applied by various methods. In the latter method, the concentration of the organic compound in the solution is from 0.01 to 20mass %, preferably from 0.05 to 5mass %, the dipping temperature is 20 to 90° C., preferably 25 to 50° C., and the dipping time is 0.1 second to 20 minutes, preferably 2 seconds to 1 minute.

The pH of the solution used in this method can be adjusted into the range of 1 to 12 with a basic material such as ammonia, triethylamine or potassium hydroxide, or an acidic material such as hydrochloric acid or phosphoric acid. A yellow dye can be added to the solution in order to improve the reproducibility of the tone of the image recording material.

The coated amount of the organic undercoat layer is appropriately 2 to 200 mg/m$^2$, and preferably 5 to 100 mg/m$^2$, in terms of obtaining sufficient printing durability.

The infrared sensitive planographic printing plate precursor thus produced is exposed imagewise and then subjected to a developing treatment.

(Plate Making)

The planographic printing plate precursor of the invention forms an image by a heat. Specifically, a direct image recording by a heat recording head or the like, scanning exposure by an infrared laser, a high illumination flash exposure such as xenon discharge lamp, an infrared lamp exposure, and the like may be used. It is preferable an exposure by a solid infrared laser with a high output such as a semiconductor laser, YAG laser, and the like, which emit infrared light having a wavelength of 700~1200 nm.

The exposed planographic printing plate precursor makes to the printing plate by a developing treatment and after-treatment with a finisher or protective gum. In these treatments, processing machines such as the known automatic processor, or the like may be used.

Treating agents used in the developing treatment and after-treatment for the planographic printing plate precursor may be selected from any known treating agents.

As the developing solution, it is preferred to use developing solutions having pH of 9.0~14.0, and more preferably, pH of 12.0~13.5. As the developing solution, an aqueous alkaline solution that has been conventionally known may be used. Among these aqueous alkaline solution, preferable examples of the developing solutions include a developing solution containing an alkaline silicate as a base or alkaline silicate obtained by mixing a base with a silicon compound, an aqueous solution which has a pH of 12 or more and is the so-called "silicate developing solution" that has been conventionally known, and a developing solution that is the so-called "non-silicate developing solution", which does not comprise any alkaline silicate but comprises a non-reducing sugar (organic compound having a buffer action) and a base, as disclosed in JP-A No. 8-305039, JP-A No. 11-109637, or the like.

Further, the developing solution may comprise an anionic surfactant and/or an amphoteric surfactant from the viewpoint of developing promotion and prevention of the slag generation.

When the planographic printing plate precursor is subjected to burning treatment, it is preferred to use a baking conditioner, a burning processor, or the like according to the conventionally known method.

The planographic printing plate obtained by the treatment described above is applied on offset printer or the like for the multi printing.

The planographic printing plate precursor of the invention has the effective suppression of the occurrence of undesired adhesion defects to recording layers, or scratching and separation due to the adhesion, even when stacked with no interleaf sheets, and has excellent handling property.

Hereinafter, the present invention will be described with reference to examples but is not limited thereto.

EXAMPLES

Examples 1 to 6 and Comparative Example 1 to 3

(Production of a Support)

(Aluminum Plate)

An aluminum alloy comprising 0.06 mass % of Si, 0.30 mass % of Fe, 0.026 mass % of Cu, 0.001 mass % of Mn, 0.001 mass % of Mg, 0.001 mass % of Zn and 0.02 mass % of Ti, with the balance made of Al and inevitable impurities, was used to prepare a molten metal. The molten metal was filtrated, and then an ingot having a thickness of 500 mm and a width of 1200 mm was produced by DC casting.

Its surface was shaved by a thickness of 10 mm on average with a surface-shaving machine, and then the ingot was kept at 550° C. for about 5 hours. When the temperature thereof lowered to 400° C., a hot rolling machine was used to produce a rolled plate having a thickness of 2.7 mm. Furthermore, a continuous annealing machine was used to thermally treat the plate thermally at 500° C. Thereafter, the plate was finished by cold rolling so as to have a thickness of 0.24 mm. In this way, an aluminum plate in accordance with JIS 1050, the disclosure of which is incorporated herein by reference) was yielded.

The short diameter of the average crystal grain size of the resultant aluminum was 50 μm, and the long diameter thereof was 300 μm. This aluminum plate was made so as to have a width of 1030 mm. Thereafter, the plate was subjected to the following surface treatment.

(Surface Treatment)

As surface treatment, the following treatments (a) to (k) were continuously conducted. After each of the treatments and water washing, liquid on the plate was removed with nip rollers.

(a) Mechanical Surface-Roughening Treatment

While supplying a suspension (specific gravity: 1.12) of an abrasive agent (pumice) in water, as an abrading slurry, onto a surface of the aluminum plate, the surface was subjected to mechanical surface-roughening treatment with rotating roller-form nylon brushes.

The average grain size of the abrasive agent was 30 μm. The maximum grain size was 100 μm. The material of the nylon brushes was 6,10-nylon, the bristle length thereof was 45 mm, and the bristle diameter thereof was 0.3 mm. The nylon brushes were each obtained by making holes in a stainless steel cylinder having a diameter of 300 mm and then planting bristles densely therein. The number of the rotating brushes used was three. The distance between the two supporting rollers (diameter: 200 mm) under each of the brushes was 300 mm.

Each of the brush rollers was pushed against the aluminum plate until the load of a driving motor for rotating the brush became 7 kW larger than the load before the brush roller was pushed against the aluminum plate. The rotating direction of the brush was the same as the moving direction of the aluminum plate. The speed of rotation of the brush was 200 rpm.

(b) Alkali Etching Treatment

A 70° C. aqueous solution having a NaOH (caustic soda) concentration of 2.6 mass % and an aluminum ion concentration of 6.5 mass % was sprayed onto the aluminum plate obtained as described above to etch the aluminum plate, thereby dissolving 10 g/m$^2$ of the aluminum plate. Thereafter, the aluminum plate was washed with sprayed water.

(c) Desmut Treatment

The aluminum plate was subjected to desmut treatment with a 30° C. aqueous solution having a nitric acid concentration of 1 mass % (and containing 0.5 mass % of aluminum ions), which was sprayed, and then washed with sprayed water. The aqueous nitric acid solution used in the desmut treatment was waste liquid from a process of conducting electrochemical surface-roughening treatment using alternating current in an aqueous nitric acid solution.

(d) Electrochemical Surface-roughening Treatment

Alternating voltage having a frequency of 60 Hz was used to conduct electrochemical surface-roughening treatment continuously. The electrolyte used at this time was a 10.5 g/L solution of nitric acid in water (containing 5 g/L of aluminum ions and 0.007 mass % of ammonium ions), and the temperature thereof was 50° C. The time TP until the current value was raised from zero to a peak was 0.8 msec, and the duty ratio of the current was 1:1. The trapezoidal wave alternating current was used, and a carbon electrode was set as a counter electrode to conduct the electrochemical surface-roughening treatment. Ferrite was used as an auxiliary anode. An electrolytic bath used is a radial cell type bath.

The density of the current was 30 A/dm$^2$ when the current was at the peak. The total electricity quantity when the aluminum plate functioned as an anode was 220 C/dm$^2$. 5% of the current sent from the power source was caused to flow into the auxiliary anode. Thereafter, the aluminum plate was washed with sprayed water.

(e) Alkali Etching Treatment

An aqueous solution having a caustic soda concentration of 26 mass % and an aluminum ion concentration of 6.5 mass % was used for spray to etch the aluminum plate at 32° C. so as to dissolve 0.50 g/m$^2$ of the aluminum plate, thereby removing smut components made mainly of aluminum hydroxide and generated when the alternating current was used to conduct the electrochemical surface-roughening treatment in the previous process, and further dissolving edges of formed pits so as to be made smooth. Thereafter, the aluminum plate was washed with sprayed water.

(f) Desmut Treatment

The aluminum plate was subjected to desmut treatment with a 30° C. aqueous solution having a sulfuric acid concentration of 15 mass % (and containing 4.5 mass % of aluminum ions), which solution was sprayed. The aluminum plate was then washed with sprayed water. The aqueous nitric acid solution used in the desmut treatment was waste liquid from the process of conducting the electrochemical surface-roughening treatment using the alternating current in the aqueous nitric acid solution.

(g) Electrochemical Surface-Roughening Treatment

Alternating voltage having a frequency of 60 Hz was used to conduct electrochemical surface-roughening treatment continuously. The electrolyte used at this time was a 5.0 g/L solution of hydrochloric acid in water (containing 5 g/L of aluminum ions), and the temperature thereof was 35° C.

The time TP until the current value was raised from zero to a peak was 0.8 msec, and the duty ratio of the current was 1:1. The trapezoidal wave alternating current was used, and a carbon electrode was set as a counter electrode to conduct the electrochemical surface-roughening treatment. Ferrite was used as an auxiliary anode. The electrolyte bath used was a radial cell type bath.

The density of the current was 25 A/dm$^2$ when the current was at the peak. The total electricity quantity when the aluminum plate functioned as an anode was 50 C/dm$^2$. Thereafter, the aluminum plate was washed with sprayed water.

(h) Alkali Etching Treatment

An aqueous solution having a caustic soda concentration of 26 mass % and an aluminum ion concentration of 6.5 mass % was sprayed onto the aluminum plate to etch the plate at 32° C. so as to dissolve 0.10 g/m$^2$ of the plate, thereby removing smut components made mainly of aluminum hydroxide and generated when the alternating current was used to conduct the electrochemical surface-roughening treatment in the previous process, and further dissolving edges of formed pits so as to be made smooth. Thereafter, the aluminum plate was washed with sprayed water.

(i) Desmut Treatment

The aluminum plate was subjected to desmut treatment with a 60° C. aqueous solution having a sulfuric acid concentration of 25 mass % (and containing 0.5 mass % of aluminum ions), which solution was sprayed. The aluminum plate was then washed with sprayed water.

(j) Anodizing Treatment

An anodizing machine in two stage power feeding electrolysis (the length of each of first and second electrolyzing sections being 6 m, the length of each of first and second power feeding sections being 3 m, and the length of each of first and second power feeding electrodes being 2.4 m) was used to conduct anodizing treatment. Sulfuric acid was used in the electrolytes supplied to the first and second electrolyzing sections. The electrolytes each had a sulfuric acid concentration of 50 g/L (and contained 0.5 mass % of aluminum ions), and the temperature thereof was 20° C. Thereafter, the plate was washed with sprayed water. The density of ultimately formed oxide film was 2.7 g/m$^2$.

(k) Treatment with Alkali Metal Silicate

The aluminum support obtained by the anodizing treatment was immersed into a treatment tank containing a 30° C. aqueous solution of #3 sodium silicate (concentration of sodium silicate: 1 mass %) for 10 seconds, so as to subject the support to treatment with the alkali metal silicate (silicate treatment). Thereafter, the support was washed with sprayed water. In this way, a support whose surface had been made hydrophilic with silicate was obtained for an infrared sensitive planographic printing plate precursor.

(Formation of Back Coat Layer (Organic Polymer Layer))

In examples 1 to 6, back coating solutions was prepared according to the following formulation which contains an organic polymer, surfactants (fluorine based surfactant B) and solvents. Thereafter, the resulting coating solution was applied onto a surface (back side) opposite to the recording layer of the support obtained above, with changing of coating amount by controlling Wet amount by a depth of groove in a bar coater. Drying after coating was performed under the following conditions:

(Drying Process A)

The coating solution for back coat having the compositions described below was applied onto the support obtained above, and dried for 30 seconds at 130° C. in an oven to form an organic polymer layer.

(Drying Process B)

The coating solution for back coat having the compositions described below was applied onto the support obtained above, and dried for 5 minutes at 170° C. in an oven to form an organic polymer layer.

(Drying Process C)

The coating solution for back coat having the compositions described below was applied onto the support obtained above, and then drying was performed as follows. Immediately after coating, the drying zone illustrated in FIG. 1 was used, and blowing with high pressure air of 3000 mmAq through slit nozzle 12 was performed together with heating at 130° C. by using a heat roller which is replaced for the guide roller 14, thereby an organic polymer layer was formed.

(Drying Process D)

The coating solution for back coat having the compositions described below was applied onto the support obtained above, and was dried for 20 seconds at 100° C. in an oven to form an organic polymer layer.

| (coating solution for the back coat) | |
|---|---|
| organic polymer (summarized in Table 1) | 25 g |
| surfactant (fluorine based surfactant B, having a structure shown below) | 0.05 g |
| solvent (summarized in Table 1) | 100 g |

Fluorine based surfactant B

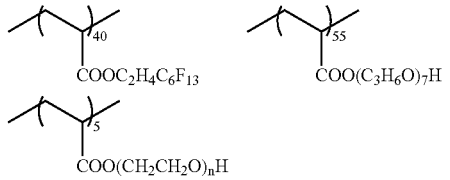

Mw: 35,000

In comparative example 1, no formation of back coat layer was performed.

In comparative examples 2 and 3, according to the conditions summarized in Table 1, coating solution for back coat was applied and dried to form a back coat layer.

(Measurement of Remaining Solvent Amount in Organic Polymer Layer (Back Coat Layer))

The amount of the solvent remaining in the back coat layer formed above was measured as follows, and the results were summarized in Tabel 1.

A photosensitive surface of a sample was scraped off with a sandpaper, and then, was measured by a gas chromatograph G-5000A(manufactured by Hitachi, Ltd.) fitted with a pyrolysis apparatus and UltraALLOY (8H) capillary column. The amount of the solvent was detected with a hydrogen flame ionization detector, and thus, the measured value was quantified by comparing with the measured value for the solvent in the known amount.

TABLE 1

| | Organic Polymer | Coating solvent | Drying Conditions | Coating amount ($g/m^2$) | remaining amount of solvent ($mg/m^2$) |
|---|---|---|---|---|---|
| Example 1 | polystyrene | methlyethylketone | A | 5 | 30 |
| Example 2 | polystyrene | methlyethylketone | B | 10 | 40 |
| Example 3 | polystyrene | methlyethylketone | C | 20 | 65 |
| Example 4 | polyethylene terephthalate | 1,1,1,3,3,3-hexafluoro-2-propanol | A | 10 | 50 |
| Example 5 | saturated polyester polymer resin(Kemit K-588) | methlyethylketone/1-methoxy-2-propanol (7/3) | B | 10 | 75 |
| Example 6 | polyvinylbutyral resin (Dencaptyral K-3000) | methlyethylketone/1-methoxy-2-propanol (7/3) | B | 10 | 50 |
| Example 7 | vinylidene acrylonitril chloride copolymer resin (Saran F-310) | methlyethylketone/1-methoxy-2-propanol (7/3) | B | 10 | 25 |
| Comparative Example 1 | — | — | — | — | — |

TABLE 1-continued

| | Organic Polymer | Coating solvent | Drying Conditions | Coating amount ($g/m^2$) | remaining amount of solvent ($mg/m^2$) |
|---|---|---|---|---|---|
| Comparative Example 2 | polystyrene | methlyethylketone | D | 10 | 120 |
| Comparative Example 3 | polystyrene | gamma-butyrolactone | B | 10 | 130 |

<Formation of Organic Undercoat Layer>

On the other side of support on which the organic polymer layer was formed, and whose surface had been made, an undercoat solution having the following composition was applied using a bar coater, and then the resultant layer was dried at 80° C. for 15 seconds to form a undercoat layer. The coated amount after drying was 18 $mg/m^2$.

<Organic undercoat solution>

| | |
|---|---|
| Polymer having the structure shown below | 0.3 g |
| Methanol | 100 g |

Mw: 28,000

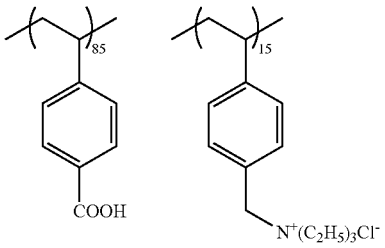

(Formation of a Recording Layer (Multilayer))

A lower layer coating solution 1 having the following composition was applied onto an aluminum support with an organic undercoat layer such that the dry coating amount was 0.85 $g/m^2$ by using a bar coater. Then, the coated layer was dried at 160° C. for 44 seconds, and then immediately cooled with cool air at 17 to 20° C. until the temperature of the support was 35° C. to form a lower layer.

Thereafter, an upper layer coating solution 2 having the following composition was applied onto the lower layer such that the dry coating amount was 0.22 $g/m^2$ by using a bar coater, then dried at 148° C. for 25 seconds and then cooled gradually with cool air at 20 to 26° C., to form an upper layer.

<Lower layer coating solution 1>

| | |
|---|---|
| Specific acetal polymer (the structure described below) (a/b/c/d = 36/37/2/2.5, weight average molecular weight: 16,000, $R^1$ = n-butyl group, $R^2$ = 4-hydroxybenzyl group) | 2.80 g |
| Novolac resin (2,3-xylenol/m-cresol/p-cresol ratio = 10/20/70, weight average molecular weight: 3,300) | 0.192 g |
| Cyanine dye A (the structure as described below) | 0.134 g |
| 4,4'-bishydroxyphenylsulfone | 0.126 g |
| Tetrahydrophthalic acid anhydride | 0.190 g |
| p-Toluenesulfonic acid | 0.008 g |
| 3-Methoxy-4-diazodiphenylamine hexafluorophosphate | 0.032 g |
| Dye obtained by changing the counter anion of Ethyl Violet to 6-hydroxy naphthalenesulfonic acid | 0.0781 g |
| Polymer 1 (the structure as described below) | 0.035 g |
| Methyl ethyl ketone | 25.41 g |
| 1-Methoxy-2-propanol | 12.97 g |
| γ-butyrolactone | 13.18 g |

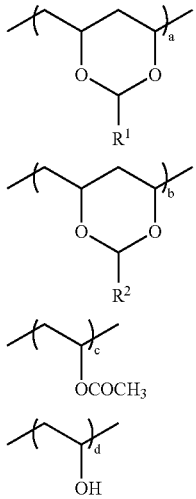

Cyanine dye A

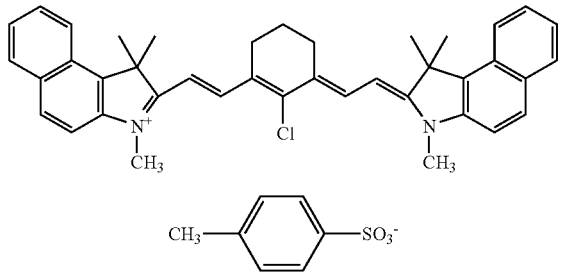

Polymer 1

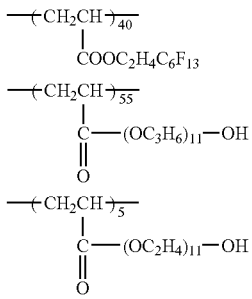

| <Upper layer coating solution 2> | |
|---|---|
| m,p-Cresol novolac (m/p ratio = 6/4, weight average molecular weight: 4500, containing 0.8 mass % unreacted cresol) | 0.3479 g |
| Polymer 3 (the structure described below, MEK 30% solution) | 0.1403 g |
| Cyanine dye A (the above structure) | 0.0192 g |
| Polymer 1 (the above structure) | 0.015 g |
| Polymer 2 (the structure described below) | 0.00328 g |
| Quaternary anmonium salt (the structure described below) | 0.0043 g |
| Surfactant (trade name: GO-4, manufactured by Nikko Chemicals (K.K.), polyoxyethylenesorbitol fatty acid ester, HLB 8.5) | 0.008 g |
| Methyl ethyl ketone | 6.79 g |
| 1-Methoxy-2-propanol | 13.07 g |

Polymer 2

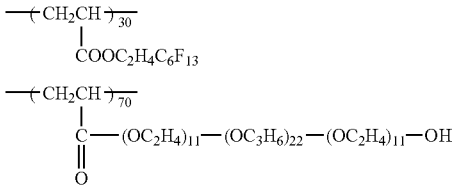

Polymer 3

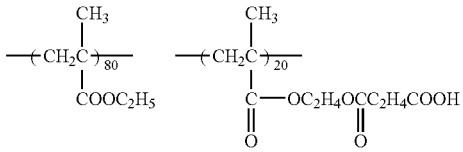

Weight average molecular weight 70,000

Quartary ammonium salt

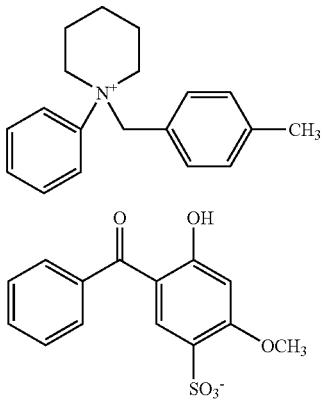

Example 7

A recording layer coating solution 3 having the following composition was applied onto the support which a back coating layer is formed according to the conditions described in Table 1 on the back side and dried for one minute in an oven at 150° C., and thus, a photosensitive planographic printing plate precursor having positive recording layer in which the coating thickness after dryingt was 2.0 g/m$^2$ in example 7 was obtained.

| <Recording layer coating solution 3> | |
|---|---|
| m, p-Cresol novolac resin (m/p ratio = 6/4, weight average molecular weight: 7,500 and unreacted cresol: 0.5 weight %) | 0.90 g |
| Methacrylic acid/ethyl methacrylate/isobutyl methacrylate (mole ratio: 26/37/37) copolymer | 0.10 g |
| Cyanine dye A (the above structure) | 0.04 g |
| 2,4,6-Tris(hexyloxy)benzenediazonium-2-hydroxy-4-methoxbenzophenone-5-sulfonate | 0.01 g |
| p-Toluenesulfonic acid | 0.002 g |
| Tetrahydrophthalic anhydride | 0.05 g |
| Dye in which obtained by changing the counter anion of Victoria pure blue BOH into an anion of 1-naphthalene sulfonic acid | 0.015 g |
| Fluorine based surfactant (Megafac F-176 manufactured by Dainippon Ink and Chemicals, Inc. | 0.02 g |
| Methylethyl ketone | 15 g |
| 1-Methoxy-2-propanol | 7 g |

—Evaluation—

Each of the resulted infrared-sensitive planographic printing plate precursors of the Examples and Comparative Examples were evaluated in the following terms: (1) occurrence of scratching during transportation, (2) adhesiveness under highly humid condition, and (3) occurrence of scratching during handling on an autoloader.

(1) Occurrence of Scratching During Transportation

Each of the resulted infrared-sensitive planographic printing plate precursors were cut into 1030 mm×800 mm-sized pieces and 30 pieces of them were stacked without interleaf sheets. The top and bottom ends of each stack were covered by a piece of cardboard having thickness of 0.5 mm. The cardboard pieces were taped at four corners and then the stacks were wrapped with aluminum kraft paper. The stacks were further wrapped with corrugated board and taped to provide packages with no interleaf sheets. The packages were carried on pallets and transported 2000 km on a lorry and then unpacked. The unpacked infrared-sensitive planographic printing plate precursors were developed in an automatic developing machine, LP-940HII (manufactured by Fuji Photo Film Co., Ltd.) with a developer, DT-2 (manufactured by Fuji Photo Film Co., Ltd., diluted to 1:8). The developing temperature was 32° C., and the developing time was 12 seconds. The electric conductivity of the developing solution was 43 mS/cm. The resulted planographic printing plates were evaluated by observing white clarity appeared in image areas caused by transportation.

Evaluation criteria were: (A) no white clarity was observed, and (B) white clarity was observed. The results are shown in Table 2.

2. Adhesiveness Under Highly Humid Condition

Each of the resulted infrared-sensitive planographic printing plate precursors were cut into the same size as above and 1500 pieces of them were stacked without interleaf sheets. The top and bottom ends of each stack were covered by an iron plate. The stacks were bolted to fix. The resulted stacks were left for one month in a mass transportation state in a warehouse in summer (i.e., July). Thereafter, the bolts were removed to evaluate adhesion of the planographic printing plate precursors.

Evaluation criteria were: (A) no adhesion was observed, and (B) adhesion was observed. The results are shown in Table 2.

3. Occurrence of Scratching During Handling on an Autoloader

The resulted planographic printing plate precursors were cut into the same size as above and 10 pieces of them were loaded in a cassette of a single autoloader, LuxelT-9800CTP without interleaf sheets. The printing plate precursors were automatically fed and mounted on a drum. The printing plate precursors were then output without being exposed. The printing plate precursors were developed in the automatic developing machine, LP-940HII (manufactured by Fuji Photo Film Co., Ltd.) with the developer, DT-2 (manufactured by Fuji Photo Film Co., Ltd., diluted to 1:8) and a finisher, FG-1 (manufactured by Fuji Photo Film Co., Ltd., diluted to 1:1). The developing temperature was 32° C., and the developing time was 12 seconds. The electric conductivity of the developing solution was 43 mS/cm. The resulted planographic printing plates were evaluated by observing scratching caused by loading and unloading.

Evaluation criteria were: (A) no scratching was observed, and (B) scratching was observed. The results are shown in Table 2.

TABLE 2

| | remaining amount of solvent per g of organic polymer (mg) | occurrence of scratching during transportation | adhesiveness under highly humid condition | occurrence of scratching during handling on an autoloader |
|---|---|---|---|---|
| Example 1 | 6.0 | A | A | A |
| Example 2 | 4.0 | A | A | A |
| Example 3 | 3.25 | A | A | A |
| Example 4 | 5.0 | A | A | A |
| Example 5 | 7.5 | A | A | A |
| Example 6 | 5.0 | A | A | A |
| Example 7 | 2.5 | A | A | A |
| Comparative Example 1 | | B | A | B |
| Comparative Example 2 | 12.0 | A | B | B |
| Comparative Example 3 | 13.0 | A | B | B |

As shown in Table 2, the infrared-sensitive planographic printing plate precursors of Examples exhibit excellent transportability and storability even when stacked and packaged without interleaf sheets, and are suitably used in an exposure device equipped with an autoloader.

The infrared-sensitive planographic printing plate precursor comprises an organic polymer layer in which the remaining amount of the solvent is controlled to that less than the specified amount on the other side of the support, that is opposite to the side having a recording layer.

In the known planographic printing plate precursor, there is sometimes one having an organic polymer layer on the back side of the support. However, in the conventional method of forming the organic polymer layer, the amount of the solvent remaining in the layer is at least 20 mg per gram of the organic polymer or more. Accordingly, the solvent remaining in the organic polymer layer results in the adhesion of the organic polymer layer and the adjacent recording layer close thereto containing an alkali soluble resin by the stress acting thereon, when the planographic printing plate precursors are stacked with no interleaf sheets, thereby scratching or separation to the recording layer is occurred.

On the other hand, in the invention, since the remaining amount of the solvent is contorlled to 10 mg per gram of the organic polymer or less, it is possible to suppress effectively the occurrence of defect due to the adhesion to the recording layer, without using a hard resin. Further, it is thought that when use a relative soft polymer in forming the organic polymer layer, stress relaxation by changing in shape of the organic polyer layer can be obtained, even when contacted with the recording layer, to exhibit the suppression effect of the occurrence of the scratching.

Accordingly, the present invention provides an infrared-sensitive positive planographic printing plate precursor with effective suppression of the occurrence of scratching during transportation or adhesion defects to recording layers due to stress acting thereon during storage, even when stacked with no interleaf sheets. The planographic printing plate precursor can be advantageously used in an exposure device equipped with an autoloader.

All publications, patent applications, and technical standards mentioned in this specification are herein incorporated by reference to the same extent as if each individual publication, patent application, or technical standard was specifically and individually indicated to be incorporated by reference.

What is claimed is:

1. An infrared-sensitive planographic printing plate precursor comprising:

a support;

a recording layer capable of forming an image through infrared irradiation provided on or above one surface of the support, the recording layer comprising a resin, which is water-insoluble and alkali-soluble, and an infrared absorbent; and an organic polymer layer provided on or above the other surface of the support, wherein when the organic polymer layer is formed, a solvent is used, and the total amount of solvent remaining in the organic polymer layer is 10 mg per gram of the organic polymer or less.

2. The infrared-sensitive planographic printing plate precursor according to claim 1, wherein the solvent(s) for the organic polymer layer is/are selected from low boiling point solvents used alone or in combination with other solvent.

3. The infrared-sensitive planographic printing plate precursor according to claim 2, wherein the solvent or a part of a mixture of solvents is a solvent having a boiling point lower than 150° C.

4. The infrared-sensitive planographic printing plate precursor according to claim 3, wherein the solvent or a part of the mixture of solvents is a solvent having a boiling point lower than 100° C.

5. The infrared-sensitive planographic printing plate precursor according to claim 1, wherein the total amount of the solvent(s) remaining in the organic polymer layer is adjusted by controlling the drying conditions.

6. The infrared-sensitive planographic printing plate precursor according to claim 5, wherein the drying is performed while passing through a drying zone equipped with a non-contact heater.

7. The infrared-sensitive planographic printing plate precursor according to claim 5, wherein the drying is performed under strong drying conditions selected from high temperature drying, drying for an extended period, drying by application of a fast air-stream or other gas-stream, and combinations thereof.

8. The infrared-sensitive planographic printing plate precursor according to claim 7, wherein the drying is performed at a high temperature of 150° C. to 190° C.

9. The infrared-sensitive planographic printing plate precursor according to claim 7, wherein the drying is performed for a time of 30 seconds to 5 minutes.

10. The infrared-sensitive planographic printing plate precursor according to claim 7, wherein the drying is performed by a blowing with high pressure air or other gas.

11. The infrared-sensitive planographic printing plate precursor according to claim 7, wherein the drying is performed by heating at a high temperature of 160° C. to 190° C. for 30 seconds to 2 minutes.

12. The infrared-sensitive planographic printing plate precursor according to claim 6, wherein drying in the drying zone is selected from a group consisting of hot-air/hot-gas drying, high-pressure air/other gas drying, drying with a heat roller, and combinations thereof.

* * * * *